US010115519B2

(12) United States Patent
Karino et al.

(10) Patent No.: US 10,115,519 B2
(45) Date of Patent: Oct. 30, 2018

(54) ELECTRONIC COMPONENT

(71) Applicant: MURATA MANUFACTURING CO., LTD., Kyoto-fu (JP)

(72) Inventors: Jun Karino, Nagaokakyo (JP); Mizuho Katsuta, Nagaokakyo (JP); Kosuke Ishida, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 178 days.

(21) Appl. No.: 15/297,416

(22) Filed: Oct. 19, 2016

(65) Prior Publication Data

US 2017/0125159 A1 May 4, 2017

(30) Foreign Application Priority Data

Nov. 2, 2015 (JP) ..... 2015-215552

(51) Int. Cl.
*H01F 5/00* (2006.01)
*H01F 27/28* (2006.01)
(Continued)

(52) U.S. Cl.
CPC ..... *H01F 27/33* (2013.01); *H01F 17/0013* (2013.01); *H01F 27/292* (2013.01);
(Continued)

(58) Field of Classification Search
USPC ..... 336/200
See application file for complete search history.

(56) References Cited

U.S. PATENT DOCUMENTS 7,091,816 B1 * 8/2006 Ito ..... H01F 17/0013 336/200
7,369,028 B2 * 5/2008 Matsunaga ..... H01F 17/0013 336/200
(Continued)

FOREIGN PATENT DOCUMENTS

JP 2000030945 A 1/2000
JP 2002373810 A 12/2002
(Continued)

OTHER PUBLICATIONS

Notification of the First Office Action issued by the State Intellectual Property Office of the People's Republic of China dated Nov. 24, 2017, which corresponds to Chinese Patent Application No. 201610969176.7 and is related to U.S. Appl. No. 15/297,416.
(Continued)

*Primary Examiner* — Ronald Hinson
(74) *Attorney, Agent, or Firm* — Studebaker & Brackett PC

(57) ABSTRACT

An electronic component includes a primary coil including n primary coil conductor layers and a parallel primary coil conductor layer, and secondary and tertiary coils including respectively n secondary and tertiary coil conductor layers. Respective ones of the primary, secondary and tertiary coil conductor layers are arrayed alternately in this order from one side toward other side in laminating direction. The parallel primary coil conductor layer is electrically connected to a predetermined primary coil conductor layer, has the substantially same shape as the predetermined primary coil conductor layer in a plan view, and is disposed on the other side in the laminating direction relative to the tertiary coil conductor layer disposed at a farthest position on the other side in the laminating direction.

9 Claims, 14 Drawing Sheets

(51) Int. Cl.
*H01F 27/33* (2006.01)
*H01F 17/00* (2006.01)
*H01F 27/29* (2006.01)

(52) U.S. Cl.
CPC ..... *H01F 2017/0066* (2013.01); *H01F 2017/0073* (2013.01); *H01F 2017/0093* (2013.01)

(56) References Cited

U.S. PATENT DOCUMENTS 7,619,500 B1 * 11/2009 Nishikawa ..... H01F 17/0013 336/200
8,988,181 B2 * 3/2015 Chang ..... H01F 17/0013 257/531
2003/0076211 A1 * 4/2003 Matsuta ..... H01F 17/0013 336/200
2003/0134612 A1 * 7/2003 Nakayama ..... H01F 17/0013 455/307
2005/0116793 A1 * 6/2005 Shoji ..... H03H 7/427 333/185
2007/0285202 A1 * 12/2007 Ito ..... H01F 17/0013 336/200
2012/0086538 A1 * 4/2012 Chu ..... H01F 17/0013 336/206

FOREIGN PATENT DOCUMENTS

JP 2007281313 A 10/2007
JP 4209851 A 1/2009

OTHER PUBLICATIONS

An Office Action; "Notification of Reasons for Refusal," Mailed by the Japanese Patent Office dated Jun. 26, 2018, which corresponds to Japanese Patent Application No. 2015-215552 and is related to U.S. Appl. No. 15/297,416; with English language translation.

* cited by examiner

ELECTRONIC COMPONENT

CROSS REFERENCE TO RELATED APPLICATIONS

This application claims benefit of priority to Japanese Patent Application 2015-215552 filed Nov. 2, 2015, the entire content of which is incorporated herein by reference.

TECHNICAL FIELD

The present disclosure relates to an electronic component including a common mode filter.

BACKGROUND

A common mode choke coil disclosed in Japanese Patent No. 4209851, for example, is known as one of disclosures regarding related-art common mode filters. FIG. 10 is a sectional structural view of a common mode choke coil 510 disclosed in Japanese Patent No. 4209851.

The common mode choke coil 510 comprises a multilayer body 512 and coils 514, 516 and 518. In a plan view, the coils 514, 516 and 518 extend from the outer peripheral side toward the inner peripheral side in a substantially spiral shape while circling clockwise, and they are overlapped with one another. The coil 518 is sandwiched between the coils 514 and 516 from the upper and lower sides. In the common mode choke coil 510, a high frequency signal is transferred to each of the coils 514 and 516, and a ground potential is connected to the coil 518.

SUMMARY

In the common mode choke coil 510 disclosed in Japanese Patent No. 4209851, however, a difference occurs in differential impedances between two of the coils among the coils 514, 516 and 518 as described below.

As illustrated in FIG. 10, the coil 514 and the coil 518 are adjacently opposed to each other, and the coil 516 and the coil 518 are adjacently opposed to each other. On the other hand, because the coil 518 is present between the coil 514 and the coil 516, the coil 514 and the coil 516 are not adjacently opposed to each other and are spaced through a relatively large distance. Accordingly, a capacitance generated between the coil 514 and the coil 516 is smaller than that generated between the coil 514 and the coil 518 and that generated between the coil 516 and the coil 518. As a result, a differential impedance generated between the coil 514 and the coil 516 is larger than that generated between the coil 514 and the coil 518 and that generated between the coil 516 and the coil 518.

Here, the differential impedance between the coil 514 and the coil 518 is equal to that between the coil 516 and the coil 518. Therefore, when a high frequency signal is transferred to each of the coils 514 and 516 and a ground potential is connected to the coil 518 as described above, a possibility of causing distortion in a waveform of the differential signal between the two high frequency signals is low.

Meanwhile, the inventors of this application have conducted studies for a technique of transferring a high frequency signal to each of the coils 514, 516 and 518 of the common mode choke coil 510, and removing common mode noise from the differential signal between two high frequency signals among those three high frequency signals. However, the differential impedance between the coil 514 and the coil 516 is larger than that between the coil 514 and the coil 518 and that between the coil 516 and the coil 518. Thus, there is a problem that, for example, a waveform of the differential signal between two high frequency signals among those three high frequency signals is distorted.

Accordingly, an object of the present disclosure is, in a common mode filter including three coils, to reduce a difference in differential impedances between two coils among those three coils.

An electronic component according to one embodiment of the present disclosure comprises a multilayer body constituted by insulator layers that are laminated in a laminating direction, a primary coil including n primary coil conductor layers and a parallel primary coil conductor layer each disposed on one of the insulator layers, n being a natural number, a secondary coil including n secondary coil conductor layers each disposed on one of the insulator layers, and a tertiary coil including n tertiary coil conductor layers each disposed on one of the insulator layers, wherein current paths of the primary coil, the secondary coil, and the tertiary coil are substantially equal to one another in length, the primary coil, the secondary coil, and the tertiary coil constitute a common mode filter, respective ones of the primary coil conductor layers, the secondary coil conductor layers, and the tertiary coil conductor layers are arrayed in the mentioned order from one side toward the other side in the laminating direction and constitute a coil conductor layer group, n coil conductor layer groups are arrayed from the one side toward the other side in the laminating direction, and the parallel primary coil conductor layer is electrically connected to a predetermined primary coil conductor layer in parallel, has a substantially same shape as the predetermined primary coil conductor layer in a plan view which is a one viewed from the laminating direction, and is disposed on the other side in the laminating direction relative to a predetermined tertiary coil conductor layer which is the tertiary coil conductor layer disposed at a farthest position on the other side in the laminating direction.

With the one embodiment of the present disclosure, in the common mode filter including three coils, a difference in differential impedances between two coils among those three coils can be reduced.

Other features, elements, characteristics and advantages of the present disclosure will become more apparent from the following detailed description of some embodiments of the present disclosure with reference to the attached drawings.

DETAILED DESCRIPTION

Electronic components according to some embodiments of the present disclosure will be described below.

(Configuration of Electronic Component)

Figure 1:
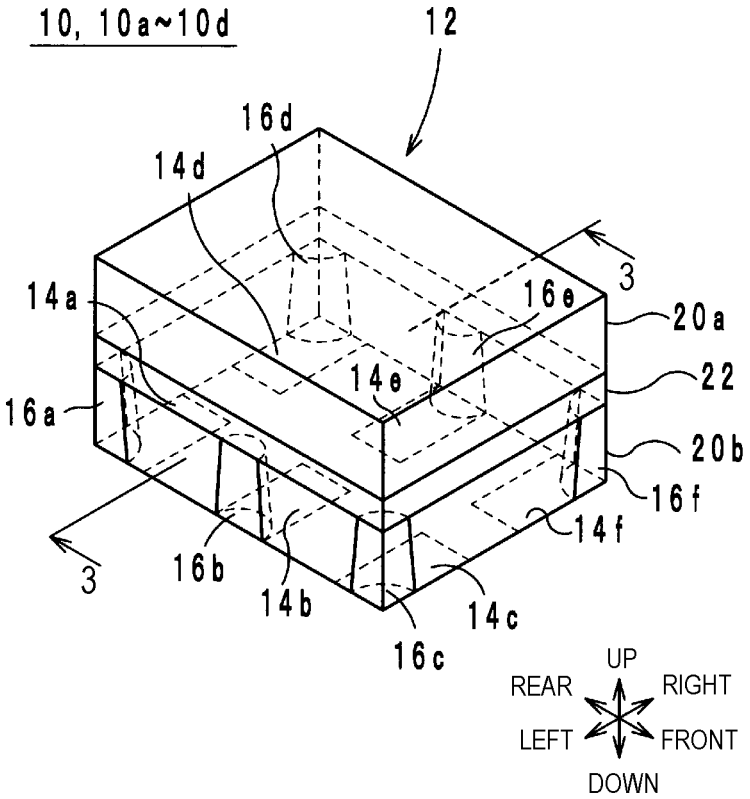
FIG. 1 is an external perspective view of each of electronic components according to an embodiment of the present disclosure and according to first to fourth modifications.
Figure 2:
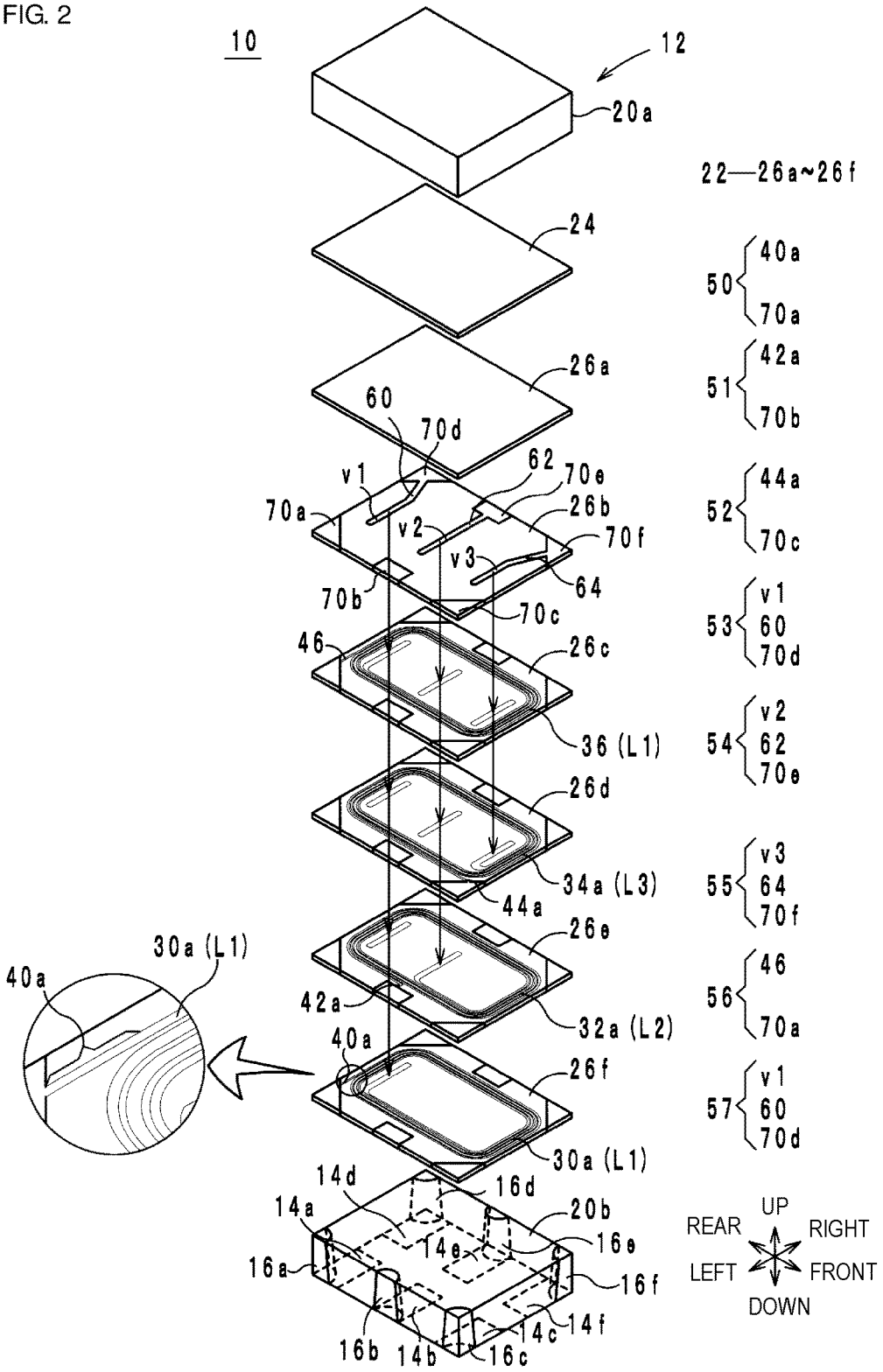
FIG. 2 is an exploded perspective view of one electronic component illustrated in FIG. 1.
Figure 3:
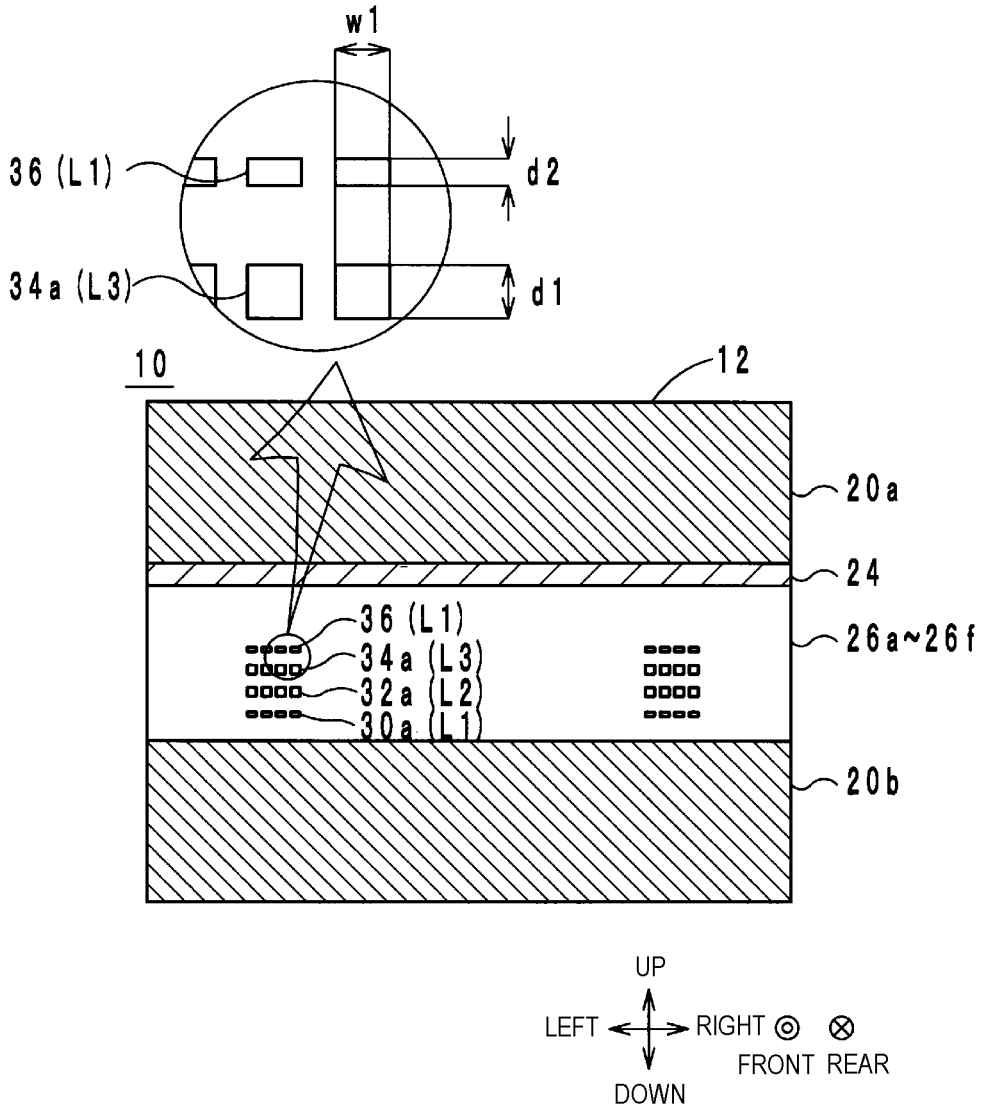
FIG. 3 is a sectional structural view, taken along 3-3, of one electronic component illustrated in FIG. 1.

First, a configuration of an electronic component 10 according to one embodiment of the present disclosure is described with reference to the drawings. FIG. 1 is an external perspective view of each of electronic components 10 and 10*a* to 10*d*. FIG. 2 is an exploded perspective view of the electronic component 10 illustrated in FIG. 1. FIG. 3 is a sectional structural view, taken along 3-3, of the electronic component 10 illustrated in FIG. 1. In the following description, an up-down direction is a laminating direction of the electronic component 10, a front-back direction is a direction in which a long side of the electronic component 10 extends in a plan view, and a left-right direction is a direction in which a short side of the electronic component 10 extends in the plan view. The up-down direction, the front-back direction, and the left-right direction are orthogonal to one another. The laminating direction represents a direction in which later-described insulator layers are laminated, a direction orthogonal to a principal surface of insulator layers on which insulator layers are laminated to be more specific. The plan view is one viewed from the laminating direction, for example, a view when viewed from above. A lower side and an upper side is one example of one side and other side in the laminating direction.

As illustrated in FIGS. 1 to 3, the electronic component 10 includes a main body 12, outer electrodes 14*a* to 14*f*, connecting portions 16*a* to 16*f*, lead-out portions 50 to 57, a primary coil L1, a secondary coil L2, and a tertiary coil L3.

As illustrated in FIGS. 1 and 2, the main body 12 has a substantially rectangular parallelepiped shape, and includes magnetic substrates 20*a* and 20*b*, a multilayer body 22, and a magnetic layer 24. The magnetic substrate 20*a*, the magnetic layer 24, the multilayer body 22, and the magnetic substrate 20*b* are successively laminated in the mentioned order from the lower side toward the upper side.

The magnetic substrates 20*a* and 20*b* are each a plate-like member having a substantially rectangular shape in the plan view. In the following, a principal surface of each of the magnetic substrates 20*a* and 20*b* on the upper side is called an upper surface, and a principal surface of each of the magnetic substrates 20*a* and 20*b* on the lower side is called a lower surface. The magnetic substrate 20*b* is partly cut out at four corners and the middle of two long sides thereof in the plan view. More specifically, a cutout having a substantially sector shape with a central angle of about 90 degrees in the plan view is formed at each of the four corners of the magnetic substrate 20*b*. A cutout having a substantially semicircular shape in the plan view is formed at the middle of each of the two long sides of the magnetic substrate 20*b*. Those six cutouts extend along lateral surfaces of the magnetic substrate 20*b* in the up-down direction from the upper surface of the magnetic substrate 20*b* until reaching the lower surface thereof.

The magnetic substrates 20*a* and 20*b* are each fabricated by cutting a sintered ferrite ceramic. Alternatively, the magnetic substrates 20*a* and 20*b* may be each fabricated by coating a paste, which is made of calcined ferrite powder and a binder, over a ceramic substrate made of, e.g., alumina, or by laminating green sheets each made of a ferrite material, and firing the laminated green sheets.

The outer electrodes 14*a* to 14*f* are disposed on the lower surface of the magnetic substrate 20*b*, and each outer electrode has a substantially rectangular shape. More specifically, the outer electrode 14*a* is disposed at a rear left corner of the lower surface of the magnetic substrate 20*b*. The outer electrode 14*b* is disposed at the middle of a long side of the lower surface of the magnetic substrate 20*b* on the left side. The outer electrode 14*c* is disposed at a front left corner of the lower surface of the magnetic substrate 20*b*. The outer electrode 14*d* is disposed at a rear right corner of the lower surface of the magnetic substrate 20*b*. The outer electrode 14*e* is disposed at the middle of a long side of the lower surface of the magnetic substrate 20*b* on the right side. The outer electrode 14*f* is disposed at a front right corner of the lower surface of the magnetic substrate 20*b*. The outer electrodes 14*a* to 14*f* are each fabricated by forming an Au film, a Ni film, a Cu film, and a Ti film in a laminated state with sputtering. Alternatively, the outer electrodes 14*a* to 14*f* may be each fabricated by applying and firing a paste that contains a metal such as Ag or Cu, or by forming a film of, e.g., Ag or Cu with evaporation or plating.

The connecting portions 16*a* to 16*f* are disposed respectively in the six cutouts formed in the magnetic substrate 20*b*. The connecting portion 16*a* is disposed in the cutout positioned at a rear left corner of the magnetic substrate 20*b* and is connected at its lower end to the outer electrode 14*a*. The connecting portion 16*b* is disposed in the cutout positioned at the middle of a long side of the magnetic substrate 20*b* on the left side and is connected at its lower end to the outer electrode 14*b*. The connecting portion 16*c* is disposed in the cutout positioned at a front left corner of the magnetic substrate 20*b* and is connected at its lower end to the outer electrode 14*c*. The connecting portion 16*d* is disposed in the cutout positioned at a rear right corner of the magnetic substrate 20*b* and is connected at its lower end to the outer electrode 14*d*. The connecting portion 16*e* is disposed in the cutout positioned at the middle of a long side of the magnetic substrate 20*b* on the right side and is connected at its lower end to the outer electrode 14*e*. The connecting portion 16*f* is disposed in the cutout positioned at a front right corner of the magnetic substrate 20*b* and is connected at its lower end to the outer electrode 14*f*. The connecting portions 16*a* to 16*f* are each fabricated by forming a conductor film, which contains Cu as a main ingredient, with plating. Alternatively, the connecting portions 16*a* to 16*f* may be each fabricated using a material with high electrical conductivity, such as Ag or Au.

The multilayer body 22 includes insulator layers 26*a* to 26*f*, one example of insulator layers, that are laminated on the upper surface of the magnetic substrate 20*b*, and it has a substantially rectangular shape in the plan view. The insulator layers 26*a* to 26*f* are laminated to array in the mentioned order from the upper side toward the lower side, and they have substantially the same size as the upper surface of the magnetic substrate 20*b*. Four corners and the middle of two long sides of each of the insulator layers 26*b* to 26*f* are cut out in the plan view.

The insulator layers 26*a* to 26*f* are each made of polyimide. Alternatively, the insulator layers 26*a* to 26*f* may be each made of an insulating resin such as benzocyclobutene, or made of an insulating inorganic material such as glass-ceramic. In the following, a principal surface of each of the insulator layers 26*a* to 26*f* on the upper side is called an upper surface, and a principal surface of each of the insulator layers 26*a* to 26*f* on the lower side is called a lower surface.

The magnetic layer 24 is disposed between the multilayer body 22 and the magnetic substrate 20*a*, and it serves to not only planarize an upper surface of the multilayer body 22, but also join the multilayer body 22 and the magnetic substrate 20*a* to each other. The magnetic layer 24 is made of, e.g., a mixture of powder of a magnetic material and resin.

The primary coil L1 is disposed inside the multilayer body 22 and includes a coil conductor layer 30*a*, one example of a primary coil conductor layer. The coil conductor layer 30*a* is disposed on the upper surface of the insulator layer 26*f*, and it has a substantially spiral shape extending from the outer peripheral side toward the inner peripheral side while circling clockwise in the plan view. In this embodiment, the coil conductor layer 30*a* has a length corresponding to about four times the circumference of the spiral shape. The center of the coil conductor layer 30*a* is substantially aligned with the center (crossed point of diagonal lines) of the electronic component 10 in the plan view.

The lead-out portion 50 connects one end of the primary coil L1 (i.e., an end portion of the coil conductor layer 30*a* on the outer peripheral side) to the outer electrode 14*a*, and it does not have the substantially spiral shape in the plan view, as illustrated in FIG. 2. The lead-out portion 50 includes a lead-out conductor layer 40*a* and a connecting conductor 70*a*. The connecting conductor 70*a* is a conductor having a substantially triangular prism shape and disposed at the rear left corners of the insulator layers 26*b* to 26*f*. In FIG. 2, for the sake of easier understanding, the connecting conductor 70*a* is illustrated in a state divided into five pieces. Similarly to the connecting conductor 70*a*, later-described connecting conductors 70*b* to 70*f* are also each illustrated in a state divided into five pieces. The connecting conductor 70*a* extends in the up-down direction from the upper surface of the insulator layer 26*b* to the lower surface of the insulator layer 26*f*, and is connected at its lower end to the connecting portion 16*a*.

The lead-out conductor layer 40*a* is disposed on the upper surface of the insulator layer 26*f*, and is connected to the end portion of the coil conductor layer 30*a* on the outer peripheral side and further to the connecting conductor 70*a*. The lead-out conductor layer 40*a* does not have the substantially spiral shape in the plan view, and it extends leftward from the end portion of the coil conductor layer 30*a* on the outer peripheral side. As illustrated in an enlarged view in FIG. 2, a boundary between the coil conductor layer 30*a* and the lead-out conductor layer 40*a* is at a position where the lead-out conductor layer 40*a* departs from the locus of the substantially spiral shape formed by the coil conductor layer 30*a*. With such an arrangement, the one end of the primary coil L1 (i.e., the end portion of the coil conductor layer 30*a* on the outer peripheral side) and the outer electrode 14*a* are electrically connected to each other through the lead-out portion 50 (including the lead-out conductor layer 40*a* and the connecting conductor 70*a*) and the connecting portion 16*a*.

The lead-out portion 53 connects the other end of the primary coil L1 (i.e., an end portion of the coil conductor layer 30*a* on the inner peripheral side) to the outer electrode 14*d*, and it does not have the substantially spiral shape in the plan view, as illustrated in FIG. 2. The lead-out portion 53 includes an interlayer connecting conductor v1, a lead-out conductor layer 60, and a connecting conductor 70*d*. The connecting conductor 70*d* is a conductor having a substantially triangular prism shape and disposed at the rear right corners of the insulator layers 26*b* to 26*f*. The connecting conductor 70*d* extends in the up-down direction from the upper surface of the insulator layer 26*b* to the lower surface of the insulator layer 26*f*, and is connected at its lower end to the connecting portion 16*d*.

The interlayer connecting conductor v1 is a conductor penetrating through the insulator layers 26*b* to 26*f* in the up-down direction, and it has a substantially linear shape extending in the left-right direction in the plan view. The interlayer connecting conductor v1 is disposed in rear half regions of the insulator layers 26*b* to 26*f* in the plan view, and is connected to the end portion of the coil conductor layer 30*a* on the inner peripheral side.

The lead-out conductor layer 60 is disposed on the upper surface of the insulator layer 26*b*, and is connected to the interlayer connecting conductor v1 and further to the connecting conductor 70*d*. With such an arrangement, the other end of the primary coil L1 (i.e., the end portion of the coil conductor layer 30*a* on the inner peripheral side) and the outer electrode 14*d* are electrically connected to each other through the lead-out portion 53 (including the interlayer connecting conductor v1, the lead-out conductor layer 60, and the connecting conductor 70*d*) and the connecting portion 16*d*.

The secondary coil L2 is disposed inside the multilayer body 22 and includes the coil conductor layer 32*a*, one example of a secondary coil conductor layer. The coil conductor layer 32*a* is disposed on the upper surface of the insulator layer 26*e*, and has a substantially spiral shape extending from the outer peripheral side toward the inner peripheral side while circling clockwise in the plan view. In this embodiment, the coil conductor layer 32*a* has a length corresponding to about four times the circumference of the spiral shape. The center of the coil conductor layer 32*a* is substantially aligned with the center (crossed point of the diagonal lines) of the electronic component 10 in the plan view.

As illustrated in FIGS. 2 and 3, the coil conductor layer 32*a* overlaps the coil conductor layer 30*a* substantially over the entire length in the plan view. Therefore, a region surrounded by the coil conductor layer 30*a* (i.e., an inner magnetic path of the primary coil L1) and a region surrounded by the coil conductor layer 32*a* (i.e., an inner magnetic path of the secondary coil L2) overlap with each other in the plan view. Thus, the coil conductor layer 30*a* (i.e., the primary coil L1) and the coil conductor layer 32*a* (i.e., the secondary coil L2) are magnetically coupled to each other. However, positions of both ends of the coil conductor layer 30*a* and positions of both ends of the coil conductor layer 32*a* are set to be different such that the lead-out portions 50 and 53 and the later-described lead-out portions 51 and 54 do not interfere with each other. More specifically, the end portion of the coil conductor layer 32*a* on the outer peripheral side is positioned upstream of the end portion of the coil conductor layer 30*a* on the outer peripheral side in the clockwise direction. The end portion of the coil conductor layer 32*a* on the inner peripheral side is positioned upstream of the end portion of the coil conductor layer 30*a* on the inner peripheral side in the clockwise direction. With such an arrangement, the length of the coil conductor layer 30*a* and the length of the coil conductor layer 32*a* are substantially equal to each other. Since the coil conductor layer 30*a* and the coil conductor layer 32*a* are just required to be magnetically coupled, they are not always required to overlap with each other over the entire length, and they may be slightly deviated in the front-back direction or the left-right direction. In other words, it is just required that the coil conductor layer 32*a* is disposed on the upper side of the coil conductor layer 30*a*.

The lead-out portion 51 connects one end of the secondary coil L2 (i.e., an end portion of the coil conductor layer 32*a* on the outer peripheral side) to the outer electrode 14*b*, and does not have the substantially spiral shape in the plan view, as illustrated in FIG. 2. The lead-out portion 51 includes a lead-out conductor layer 42*a* and a connecting conductor 70*b*. The connecting conductor 70*b* is a conductor having a substantially quadrangular prism shape and disposed at the middle of the long sides of the insulator layers 26*b* to 26*f* on the left side. The connecting conductor 70*b* extends in the up-down direction from the upper surface of the insulator layer 26*b* to the lower surface of the insulator layer 26*f*, and is connected at its lower end to the connecting portion 16*b*.

The lead-out conductor layer 42*a* is disposed on the upper surface of the insulator layer 26*e*, and is connected to the end portion of the coil conductor layer 32*a* on the outer peripheral side and further to the connecting conductor 70*b*. The lead-out conductor layer 42*a* does not have the substantially spiral shape in the plan view, and it extends leftward from the end portion of the coil conductor layer 32*a* on the outer peripheral side. With such an arrangement, the one end of the secondary coil L2 (i.e., the end portion of the coil conductor layer 32*a* on the outer peripheral side) and the outer electrode 14*b* are electrically connected to each other through the lead-out portion 51 (including the lead-out conductor layer 42*a* and the connecting conductor 70*b*) and the connecting portion 16*b*.

The lead-out portion 54 connects the other end of the secondary coil L2 (i.e., an end portion of the coil conductor layer 32*a* on the inner peripheral side) to the outer electrode 14*e*, and does not have the substantially spiral shape in the plan view, as illustrated in FIG. 2. The lead-out portion 54 includes an interlayer connecting conductor v2, a lead-out conductor layer 62, and a connecting conductor 70*e*. The connecting conductor 70*e* is a conductor having a substantially quadrangular prism shape and disposed at the middle of the long sides of the insulator layers 26*b* to 26*f* on the right side. The connecting conductor 70*e* extends in the up-down direction from the upper surface of the insulator layer 26*b* to the lower surface of the insulator layer 26*f*, and is connected at its lower end to the connecting portion 16*e*.

The interlayer connecting conductor v2 is a conductor penetrating through the insulator layers 26*b* to 26*e* in the up-down direction, and has a substantially linear shape extending in the left-right direction in the plan view. The interlayer connecting conductor v2 is disposed in central regions of the insulator layers 26*b* to 26*e* in the plan view, and is connected to the end portion of the coil conductor layer 32*a* on the inner peripheral side.

The lead-out conductor layer 62 is disposed on the upper surface of the insulator layer 26*b*, and is connected to the interlayer connecting conductor v2 and further to the connecting conductor 70*e*. With such an arrangement, the other end of the secondary coil L2 (i.e., the end portion of the coil conductor layer 32*a* on the inner peripheral side) and the outer electrode 14*e* are electrically connected to each other through the lead-out portion 54 (including the interlayer connecting conductor v2, the lead-out conductor layer 62, and the connecting conductor 70*e*) and the connecting portion 16*e*.

The tertiary coil L3 is disposed inside the multilayer body 22 and includes the coil conductor layer 34*a*, one example of a tertiary coil conductor layer. The coil conductor layer 34*a* is disposed on the upper surface of the insulator layer 26*d*, and has a substantially spiral shape extending from the outer peripheral side toward the inner peripheral side while circling clockwise in the plan view. In this embodiment, the coil conductor layer 34*a* has a length corresponding to about four times the circumference of the spiral shape. The center of the coil conductor layer 34*a* is substantially aligned with the center (crossed point of the diagonal lines) of the electronic component 10 in the plan view.

As illustrated in FIGS. 2 and 3, the coil conductor layer 34*a* overlaps the coil conductor layers 30*a* and 32*a* substantially over the entire length in the plan view. Therefore, the region surrounded by the coil conductor layer 30*a* (i.e., the inner magnetic path of the primary coil L1), the region surrounded by the coil conductor layer 32*a* (i.e., the inner magnetic path of the secondary coil L2), and a region surrounded by the coil conductor layer 34*a* (i.e., an inner magnetic path of the tertiary coil L3) overlap with one another in the plan view. Thus, the coil conductor layer 30*a* (i.e., the primary coil L1), the coil conductor layer 32*a* (i.e., the secondary coil L2), and the coil conductor layer 34*a* (i.e., the tertiary coil L3) are magnetically coupled to one another. However, the positions of both the ends of the coil conductor layer 30*a*, the positions of both the ends of the coil conductor layer 32*a*, and positions of both ends of the coil conductor layer 34*a* are set to be different such that the lead-out portions 50 and 53, the lead-out portions 51 and 54, and later-described lead-out portions 52 and 55 do not interfere with one another. More specifically, the end portion of the coil conductor layer 34*a* on the outer peripheral side is positioned upstream of the end portions of the coil conductor layers 30*a* and 32*a* on the outer peripheral side in the clockwise direction. The end portion of the coil conductor layer 34*a* on the inner peripheral side is positioned upstream of the end portions of the coil conductor layers 30*a* and 32*a* on the inner peripheral side in the clockwise direction. With such an arrangement, the length of the coil conductor layer 30*a*, the length of the coil conductor layer 32*a*, and the length of the coil conductor layer 34*a* are substantially equal to one another. Since the coil conductor layer 30*a*, the coil conductor layer 32*a*, and the coil conductor layer 34*a* are just required to be magnetically coupled, they are not always required to overlap with one another over the entire length, and they may be slightly deviated in the front-back direction or the left-right direction. In other words, it is just required that the coil conductor layer 34*a* is disposed on the upper side of the coil conductor layers 30*a* and 32*a*.

The lead-out portion 52 connects one end of the tertiary coil L3 (i.e., an end portion of the coil conductor layer 34*a* on the outer peripheral side) to the outer electrode 14*c*, and does not have the substantially spiral shape in the plan view, as illustrated in FIG. 2. The lead-out portion 52 includes a lead-out conductor layer 44*a* and a connecting conductor 70*c*. The connecting conductor 70*c* is a conductor having a substantially triangular prism shape and disposed at the front left corners of the insulator layers 26*b* to 26*f*. The connecting conductor 70*c* extends in the up-down direction from the upper surface of the insulator layer 26*b* to the lower surface of the insulator layer 26*f*, and is connected at its lower end to the connecting portion 16*c*.

The lead-out conductor layer 44*a* is disposed on the upper surface of the insulator layer 26*d*, and is connected to the end portion of the coil conductor layer 34*a* on the outer peripheral side and further to the connecting conductor 70*c*. The lead-out conductor layer 44*a* does not have the substantially spiral shape in the plan view, and it extends forward from the end portion of the coil conductor layer 34*a* on the outer peripheral side. With such an arrangement, the one end of the tertiary coil L3 (i.e., the end portion of the coil conductor layer 34*a* on the outer peripheral side) and the outer electrode 14*c* are electrically connected to each other through the lead-out portion 52 (including the lead-out conductor layer 44*a* and the connecting conductor 70*c*) and the connecting portion 16*c*.

The lead-out portion 55 connects the other end of the tertiary coil L3 (i.e., an end portion of the coil conductor layer 34*a* on the inner peripheral side) to the outer electrode 14*f*, and does not have the substantially spiral shape in the plan view, as illustrated in FIG. 2. The lead-out portion 55 includes an interlayer connecting conductor v3, a lead-out conductor layer 64, and a connecting conductor 70*f*. The connecting conductor 70*f* is a conductor having a substantially triangular prism shape and disposed at the front right corners of the insulator layers 26*b* to 26*f*. The connecting conductor 70*f* extends in the up-down direction from the upper surface of the insulator layer 26*b* to the lower surface of the insulator layer 26*f*, and is connected at its lower end to the connecting portion 16*f*.

The interlayer connecting conductor v3 is a conductor penetrating through the insulator layers 26*b* to 26*d* in the up-down direction, and has a substantially linear shape extending in the left-right direction in the plan view. The interlayer connecting conductor v3 is disposed in front half regions of the insulator layers 26*b* to 26*d* in the plan view, and is connected to the end portion of the coil conductor layer 34*a* on the inner peripheral side.

The lead-out conductor layer 64 is disposed on the upper surface of the insulator layer 26*b*, and is connected to the interlayer connecting conductor v3 and further to the connecting conductor 70*f*. With such an arrangement, the other end of the tertiary coil L3 (i.e., the end portion of the coil conductor layer 34*a* on the inner peripheral side) and the outer electrode 14*f* are electrically connected to each other through the lead-out portion 55 (including the interlayer connecting conductor v3, the lead-out conductor layer 64, and the connecting conductor 70*f*) and the connecting portion 16*f*.

The primary coil L1 further includes a parallel coil conductor layer 36, one example of a parallel primary coil conductor layer. The parallel coil conductor layer 36 is electrically connected to the coil conductor layer 30*a*, one example of a predetermined primary coil conductor layer, in parallel. The parallel coil conductor layer 36 has a substantially same shape as the coil conductor layer 30*a* in a plan view and is disposed on the upper side relative to the coil conductor layer 34*a*, one example of a predetermined tertiary coil conductor layer, that is disposed at an uppermost position among the coil conductor layers 30*a*, 32*a* and 34*a*. In other words, the parallel coil conductor layer 36 is disposed on the upper surface of the insulator layer 26*c*, and has a substantially spiral shape extending from the outer peripheral side toward the inner peripheral side while circling clockwise in the plan view. In this embodiment, the parallel coil conductor layer 36 has a length corresponding to about four times the circumference of the spiral shape. The center of the parallel coil conductor layer 36 is substantially aligned with the center (crossed point of the diagonal lines) of the electronic component 10 in the plan view.

The lead-out portion 56 connects an end portion of the parallel coil conductor layer 36 on the outer peripheral side to the outer electrode 14*a*, and does not have the substantially spiral shape in the plan view, as illustrated in FIG. 2. The lead-out portion 56 includes a lead-out conductor layer 46 and the connecting conductor 70*a*. The lead-out conductor layer 46 is disposed on the upper surface of the insulator layer 26*c*, and is connected to the end portion of the parallel coil conductor layer 36 on the outer peripheral side and further to the connecting conductor 70*a*. The lead-out conductor layer 46 does not have the substantially spiral shape in the plan view, and extends leftward from the end portion of the parallel coil conductor layer 36 on the outer peripheral side. With such an arrangement, the end portion of the parallel coil conductor layer 36 on the outer peripheral side and the outer electrode 14*a* are electrically connected to each other through the lead-out portion 56 (including the lead-out conductor layer 46 and the connecting conductor 70*a*) and the connecting portion 16*a*.

The lead-out portion 57 connects the end portion of the parallel coil conductor layer 36 on the inner peripheral side to the outer electrode 14*d*, and does not have the substantially spiral shape in the plan view, as illustrated in FIG. 2. The lead-out portion 57 includes the interlayer connecting conductor v1, the lead-out conductor layer 60, and the connecting conductor 70*d*. Because the interlayer connecting conductor v1, the lead-out conductor layer 60, and the connecting conductor 70*d* have already been described above, further description of those members is omitted here. With the above-mentioned arrangement, the end portion of the parallel coil conductor layer 36 on the inner peripheral side and the outer electrode 14*d* are electrically connected to each other through the lead-out portion 57 (including the interlayer connecting conductor v1, the lead-out conductor layer 60, and the connecting conductor 70*d*) and the connecting portion 16*d*. Thus, the parallel coil conductor layer 36 is electrically connected to the coil conductor layer 30*a* in parallel.

The coil conductor layers 30*a*, 32*a* and 34*a*, the parallel coil conductor layer 36, the lead-out conductor layer 40*a*, 42*a*, 44*a*, 46, 60, 62 and 64, and the connecting conductors 70*a* to 70*f* are each formed by coating a film with sputtering of Ag. Alternatively, the coil conductor layers 30*a*, 32*a* and 34*a*, the parallel coil conductor layer 36, the lead-out conductor layer 40*a*, 42*a*, 44*a*, 46, 60, 62 and 64, and the connecting conductors 70*a* to 70*f* may be formed using another material with high electrical conductivity, such as Cu or Au.

As described above, in the primary coil L1, the coil conductor layer 30*a* and the parallel coil conductor layer 36 have the same shape, and they are electrically connected in parallel. Moreover, the length of the coil conductor layer 30*a*, the length of the coil conductor layer 32*a*, the length of the coil conductor layer 34*a*, and the length of the parallel coil conductor layer 36 are substantially equal to one another. Therefore, current paths of the primary coil L1, the secondary coil L2, and the tertiary coil L3 are substantially equal to one another in length. The expression "current paths are substantially equal in length" implies that slight differences among the lengths of the coil conductor layers 30*a*, 32*a*, 34*a* and 36 are regarded to be not substantial, those slight differences being generated by arranging the positions of the lead-out conductor layer 40*a*, 42*a*, 44*a* and 46 and the interlayer connecting conductors v1 to v3 so as not to interfere with one another.

Moreover, the coil conductor layers 30*a*, 32*a* and 34*a* and the parallel coil conductor layer 36 are constituted such that a total of a sectional area of the coil conductor layer 30*a* and a sectional area of the parallel coil conductor layer 36 is substantially equal to a sectional area of the coil conductor layer 32*a* and a sectional area of the coil conductor layer 34*a*. More specifically, as illustrated in FIG. 3, a line width of the coil conductor layer 30*a*, a line width of the coil conductor layer 32*a*, a line width of the coil conductor layer 34*a*, and a line width of the parallel coil conductor layer 36 are substantially equal to one another as denoted by a line width w1. However, each of the coil conductor layers 32*a* and 34*a* has a thickness d1, and each of the coil conductor layer 30*a* and the parallel coil conductor layer 36 has a thickness d2. The thickness d2 is about a half of the thickness d1. Thus, the respective sectional areas of the coil conductor layer 30*a* and the parallel coil conductor layer 36 are substantially equal to each other and are each about a half the sectional area of each of the coil conductor layers 32*a* and 34*a*. Accordingly, the total of the sectional area of the coil conductor layer 30*a* and the sectional area of the parallel coil conductor layer 36 is substantially equal to the sectional area of the coil conductor layer 32*a* and the sectional area of the coil conductor layer 34*a*. On that condition, a resistance value of each of the coil conductor layer 30*a* and the parallel coil conductor layer 36 is about twice that of each of the coil conductor layers 32*a* and 34*a*. In this respect, the coil conductor layer 30*a* and the parallel coil conductor layer 36 are electrically connected in parallel. Thus, in the current paths of the primary coil L1, the secondary coil L2, and the tertiary coil L3, a sectional area of the primary coil L1, a sectional area of the secondary coil L2, and a sectional area of the tertiary coil L3 are substantially equal to one another. As a result, a resistance value of the primary coil L1, a resistance value of the secondary coil L2, and a resistance value of the tertiary coil L3 are substantially equal to one another.

The sectional area of the coil conductor layer in the above description is defined as a sectional area taken in a section of the coil conductor layer perpendicular to a direction in which the coil conductor layer extends lengthwise. The thickness of the coil conductor layer is defined as a thickness of the coil conductor layer in the up-down direction. The line width of the coil conductor layer is defined as a width of the section of the coil conductor layer perpendicular to the extending direction of the coil conductor layer, the width being taken in a direction perpendicular to the up-down direction of the coil conductor layer.

Furthermore, an interval between the coil conductor layer 30*a* and the coil conductor layer 32*a*, an interval between the coil conductor layer 32*a* and the coil conductor layer 34*a*, and an interval between the coil conductor layer 34*a* and the parallel coil conductor layer 36 are substantially equal to one another. In other words, the intervals between two coils conductor layers among the coil conductor layers 30*a*, 32*a*, 34*a* and 36, every two of those being adjacent to each other in the up-down direction, are substantially the same. Here, the interval between the coil conductor layers is defined as a distance between opposing surfaces of the two adjacent coil conductor layers.

An operation of the electronic component 10 having the above configuration will be described below. The outer electrodes 14*a* to 14*c* are used as input terminals for example. The outer electrodes 14*d* to 14*f* are used as output terminals for example. The primary coil L1, the secondary coil L2, and the tertiary coil L3 are magnetically coupled.

A first signal S1, a second signal S2, and a third signal S3 are input respectively to the outer electrodes 14*a*, 14*b* and 14*c*. The first signal S1, the second signal S2, and the third signal S3 are assumed to be provided as follows. The first signal S1, the second signal S2, and the third signal S3 take three different arbitrary voltage values of high (H), middle (M) and low (L), and they transit among the three values H, M and L at the same clock. Furthermore, at the timing when one signal takes the value H, one of the remaining two signals takes the value M, and the other signal takes the value L. In other words, the first signal S1, the second signal S2, and the third signal S3 exclusively transit among the three values H, M and L. In that case, a total of the voltage values of the first signal S1, the second signal S2, and the third signal S3 is substantially always constant at (H+M+L), and a "total" change amount of the voltages due to the transition is almost zero (0). Accordingly, a "total" change amount of currents generated in the primary coil L1, the secondary coil L2, and the tertiary coil L3 is also almost zero (0), and a change amount of magnetic fluxes generated in the electronic component 10 is almost zero "0" (although magnetic flux generated in each of the primary coil L1, the secondary coil L2, and the tertiary coil L3 changes, the changes of the magnetic fluxes cancel each other). When there is substantially no change of the magnetic flux as described above, any impedance is substantially not generated in the electronic component 10, and hence the electronic component 10 does not cause any influence upon the first signal S1, the second signal S2, and the third signal S3.

On the other hand, with respect to common mode noise, i.e., in-phase noise contained in the first signal S1, the second signal S2, and the third signal S3, magnetic fluxes generated in the primary coil L1, the secondary coil L2, and the tertiary coil L3 are changed in the same direction, and the changes of the magnetic fluxes do not cancel each other. Therefore, the electronic component 10 exhibits a large impedance for the common mode noise. Hence the common mode noise can be reduced in the electronic component 10. As described above, the primary coil L1, the secondary coil L2, and the tertiary coil L3 constitute a common mode filter, and the electronic component 10 can reduce the common mode noise without affecting the first signal S1, the second signal S2, and the third signal S3. Thus, the electronic component 10 functions as the common mode filter for the first signal S1, the second signal S2, and the third signal S3.

(Manufacturing Method for Electronic Component)

A manufacturing method for the electronic component 10 will be described below with reference to the drawings. The following description is made in connection with an example in which one electronic component 10 is manufactured. In practice, however, the plurality of electronic components 10 are formed at the same time by laminating mother magnetic substrates and mother insulator layers, each having a large size, to fabricate a mother body, and by cutting the mother body into a plurality of pieces.

First, a photosensitive resin, e.g., a polyimide resin, is coated over the entire upper surface of the magnetic substrate 20*b*. Then, the polyimide resin is exposed in a state blocked off against light with a photoresist at positions corresponding to the four corners and the middle of the two long sides of the insulator layer 26*f*. As a result, the polyimide resin in a region having been not blocked off against light is solidified. After removing the photoresist with an organic solvent, the polyimide resin is developed to remove the not-solidified polyimide resin and to thermally-solidify the remaining polyimide resin. As a result, the insulator layer 26*f* is formed.

Next, an Ag film is formed on the insulator layer 26*f* and on the magnetic substrate 20*b*, which is exposed from the insulator layer 26*f*, by sputtering. Then, a photoresist is formed on regions where the coil conductor layer 30*a*, the lead-out conductor layer 40*a*, the connecting conductors 70*a* to 70*f*, and the interlayer connecting conductor v1 are to be formed. Then, the Ag film is removed by etching from a region except for the regions where the coil conductor layer 30*a*, the lead-out conductor layer 40*a*, the connecting conductors 70*a* to 70*f*, and the interlayer connecting conductor v1 are to be formed (i.e., except for the regions covered with the photoresist). Thereafter, the photoresist is removed with an organic solvent, thus forming the coil conductor layer 30*a*, the lead-out conductor layer 40*a*, respective one parts (corresponding to one layer) of the connecting conductors 70*a* to 70*f*, and the interlayer connecting conductor v1.

The insulator layers 26*a* to 26*e*, the coil conductor layers 32*a* and 34*a*, the parallel coil conductor layer 36, the lead-out conductor layers 42*a*, 44*a*, 46, 60, 62 and 64, respective remaining parts of the connecting conductors 70*a* to 70*f*, and the interlayer connecting conductor v2 and v3 are formed by repeating similar steps to those described above.

Next, a magnetic paste becoming the magnetic layer 24 is coated over the multilayer body 22, and the magnetic substrate 20*a* is pressure-bonded onto the magnetic layer 24.

Next, the six cutouts are formed in the magnetic substrate 20*b* by sand blasting. Those cutouts may be formed by laser processing instead of the sand blasting, or by a combination of the sand blasting and the laser processing.

Finally, conductor layers are formed on inner peripheral surfaces of the cutouts of the magnetic substrate 20*b* with a combination of electrolytic plating and photolithography, whereby the connecting portions 16*a* to 16*f* and the outer electrodes 14*a* to 14*f* are formed.

ADVANTAGEOUS EFFECTS

With the electronic component 10 according to this embodiment, difference in differential impedances between two of the primary coil, the secondary coil, and the tertiary coil can be reduced. To explain in more detail, assuming that an inductance value of the entire electronic component 10 including the coils is denoted by L and a capacitance value thereof is denoted by C when a measurement current (or a differential signal) flows through the electronic component, the differential impedance is expressed by root of L/C. C includes capacitances between the coil conductor layers (i.e., parasitic capacitances). In the current paths of the primary coil L1, the secondary coil L2, and the tertiary coil L3 in the electronic component 10, the sectional area of the primary coil L1, the sectional area of the secondary coil L2, and the sectional area of the tertiary coil L3 are substantially equal to one another. Furthermore, current paths of the primary coil L1, the secondary coil L2, and the tertiary coil L3 are substantially equal to one another in length. The primary coil L1, the secondary coil L2 and the tertiary coil L3 are substantially equal in turn numbers. As a result, inductance values of the primary coil L1, the secondary coil L2, and the tertiary coil L3 are substantially equal to one another.

In the electronic component 10, the parallel coil conductor layer 36 is disposed on the upper side of the coil conductor layer 34*a* that is disposed at the uppermost position among the coil conductor layers 30*a*, 32*a* and 34*a*. With such an arrangement, a capacitance is generated between the coil conductor layer 34*a* and the parallel coil conductor layer 36. A capacitance between the primary coil L1 and the secondary coil L2 is formed mainly by the capacitance between the coil conductor layer 30*a* and the coil conductor layer 32*a*. A capacitance between the secondary coil L2 and the tertiary coil L3 is formed mainly by the capacitance between the coil conductor layer 32*a* and the coil conductor layer 34*a*. A capacitance between the tertiary coil L3 and the primary coil L1 is formed mainly by the capacitance between the parallel coil conductor layer 36 and the coil conductor layer 34*a*. Thus, C values can be made closer for the differential impedances between two coils among the three coils. As a result, the differential impedance between the primary coil L1 and the secondary coil L2, the differential impedance between the secondary coil L2 and the tertiary coil L3, and the differential impedance between the tertiary coil L3 and the primary coil L1 come closer to one another. Moreover, respective coupling degrees between the primary coil L1 and the secondary coil L2, between the secondary coil L2 and the tertiary coil L3, and between the tertiary coil L3 and the primary coil L1 also come closer to one another.

According to the electronic component 10, as described above, in the current paths of the primary coil L1, the secondary coil L2, and the tertiary coil L3, the sectional area of the primary coil L1, the sectional area of the secondary coil L2, and the sectional area of the tertiary coil L3 are substantially equal to one another. As a result, the resistance value of the primary coil L1, the resistance value of the secondary coil L2, and the resistance value of the tertiary coil L3 are substantially equal to one another. Thus, respective values of currents flowing through the primary coil L1, the secondary coil L2, and the tertiary coil L3 can be made closer to one another, and respective amounts of heat generated from the primary coil L1, the secondary coil L2, and the tertiary coil L3 can also be made closer to one another.

When the resistance value of the primary coil L1, the resistance value of the secondary coil L2, and the resistance value of the tertiary coil L3 are substantially equal to one another, directivity of the electronic component 10 is eliminated. This implies that the outer electrodes 14*a* to 14*c* may be used as the input terminals and the outer electrodes 14*d* to 14*f* may be used as the output terminals, or that the outer electrodes 14*a* to 14*c* may be used as the output terminals and the outer electrodes 14*d* to 14*f* may be used as the input terminals. As a result, in the electronic component 10, it is no longer required to identify the orientation of the electronic component 10 when it is mounted, and to attach an orientation identification mark. Furthermore, since respective characteristics of the primary coil L1, the secondary coil L2, and the tertiary coil L3 are substantially equal to one another, three signals may be each input to any one of the primary coil L1, the secondary coil L2, and the tertiary coil L3. Thus, the wiring layout of a circuit board to which the electronic component 10 is mounted is not limited by the electronic component 10.

According to the electronic component 10, a heat amount generated from the coil conductor layer 30*a* can be made closer to that generated from the parallel coil conductor layer 36. To explain in more detail, the sectional area of the coil conductor layer 30*a* is substantially equal to that of the parallel coil conductor layer 36. In addition, the length of the coil conductor layer 30*a* is substantially equal to that of the parallel coil conductor layer 36. Therefore, the resistance value of the coil conductor layer 30*a* is substantially equal to that of the parallel coil conductor layer 36. Moreover, since the coil conductor layer 30*a* and the parallel coil conductor layer 36 are electrically connected in parallel, voltages applied to the coil conductor layer 30*a* and the parallel coil conductor layer 36 are substantially equal to each other, and currents flowing through the coil conductor layer 30*a* and the parallel coil conductor layer 36 are also substantially equal to each other. Hence the amount of heat generated from the coil conductor layer 30*a* can be made closer to that generated from the parallel coil conductor layer 36.

The inventors of this application conducted computer simulations, described below, with an intent to clarify that difference in differential impedances between two of the primary coil L1, the secondary coil L2, and the tertiary coil L3 can be reduced. To explain in more detail, a model having the same structure as the electronic component 10 was fabricated as a first model according to the embodiment. A model not including the parallel coil conductor layer 36 in the electronic component 10 was fabricated as a second model according to a comparative example. The differential impedances between two of the primary coil L1, the secondary coil L2, and the tertiary coil L3 were computed for each of the first model and the second model. The computation was executed such that, when computing the differential impedance between the primary coil L1 and the secondary coil L2, for example, a differential signal was input to each of the primary coil L1 and the secondary coil L2, and the tertiary coil L3 was terminated at 50Ω relative to a ground potential.

Figure 4:
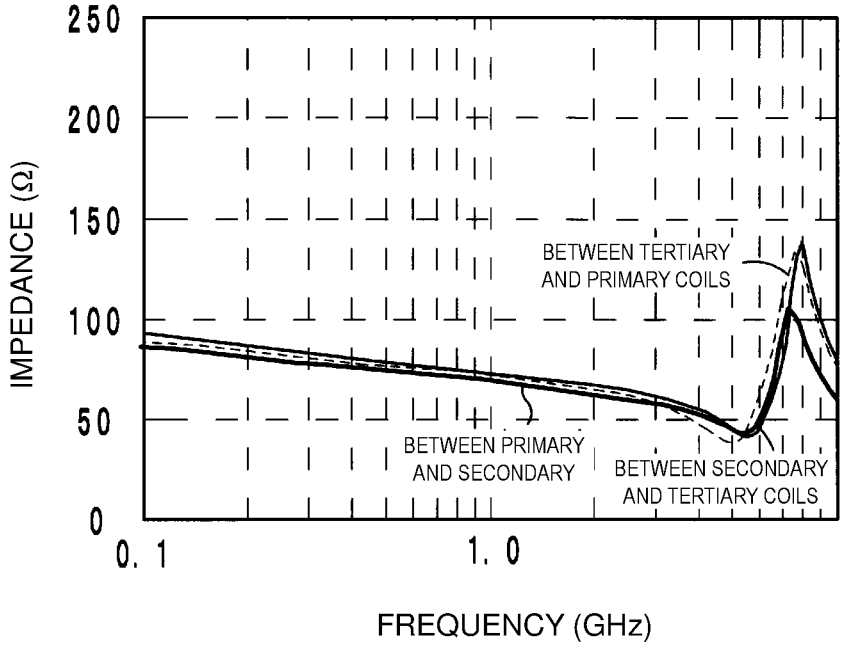
FIG. 4 is a graph representing a simulation result of a first model.
Figure 5:
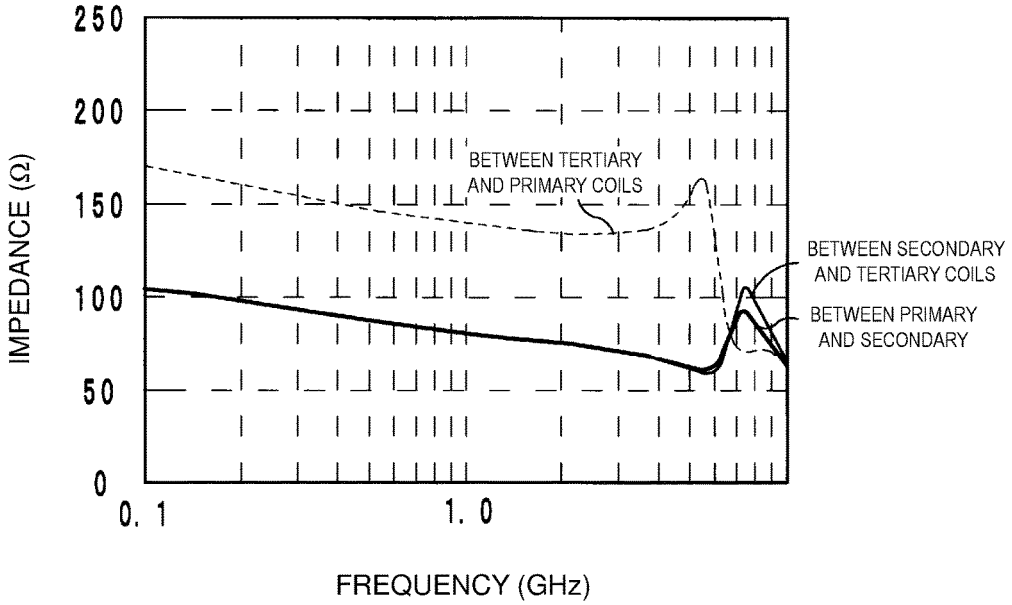
FIG. 5 is a graph representing a simulation result of a second model.

FIG. 4 is a graph representing a simulation result of the first model. FIG. 5 is a graph representing a simulation result of the second model. In FIGS. 4 and 5, the vertical axis indicates differential impedance, and the horizontal axis indicates frequency.

As seen from FIG. 5, in the second model, the differential impedance between the tertiary coil L3 and the primary coil L1 is larger than the differential impedance between the primary coil L1 and the secondary coil L2 and the differential impedance between the secondary coil L2 and the tertiary coil L3.

On the other hand, as seen from FIG. 4, in the first model, the differential impedance between the primary coil L1 and the secondary coil L2, the differential impedance between the secondary coil L2 and the tertiary coil L3, and the differential impedance between the tertiary coil L3 and the primary coil L1 are comparatively close to one another. It is hence understood that, in the electronic component 10, the variation in differential impedances between two of the primary coil L1, the secondary coil L2, and the tertiary coil L3 can be reduced.

(First Modification)

Figure 6A:
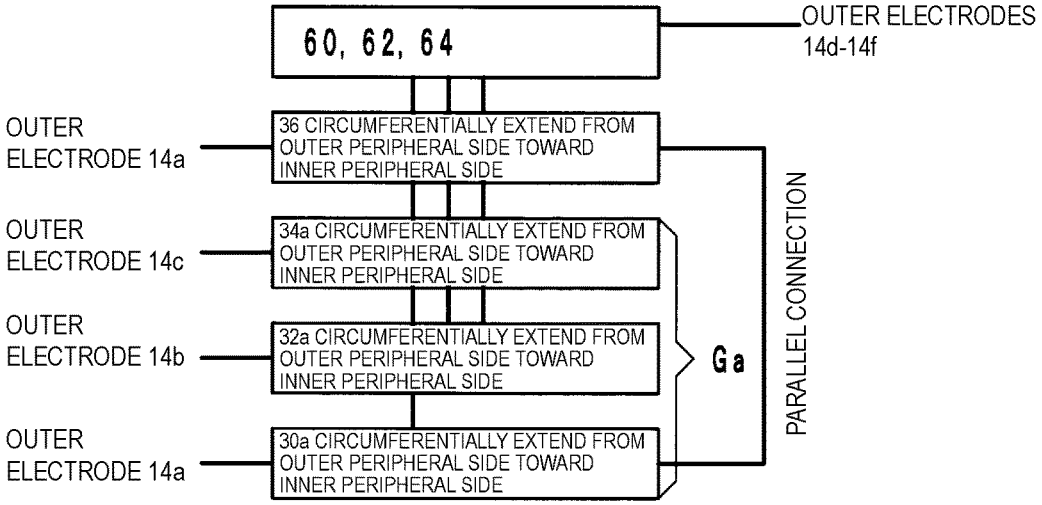
FIG. 6A is a schematic view illustrating a positional relation among coil conductor layers and a parallel coil conductor layer of the electronic component according to the embodiment.
Figure 6B:
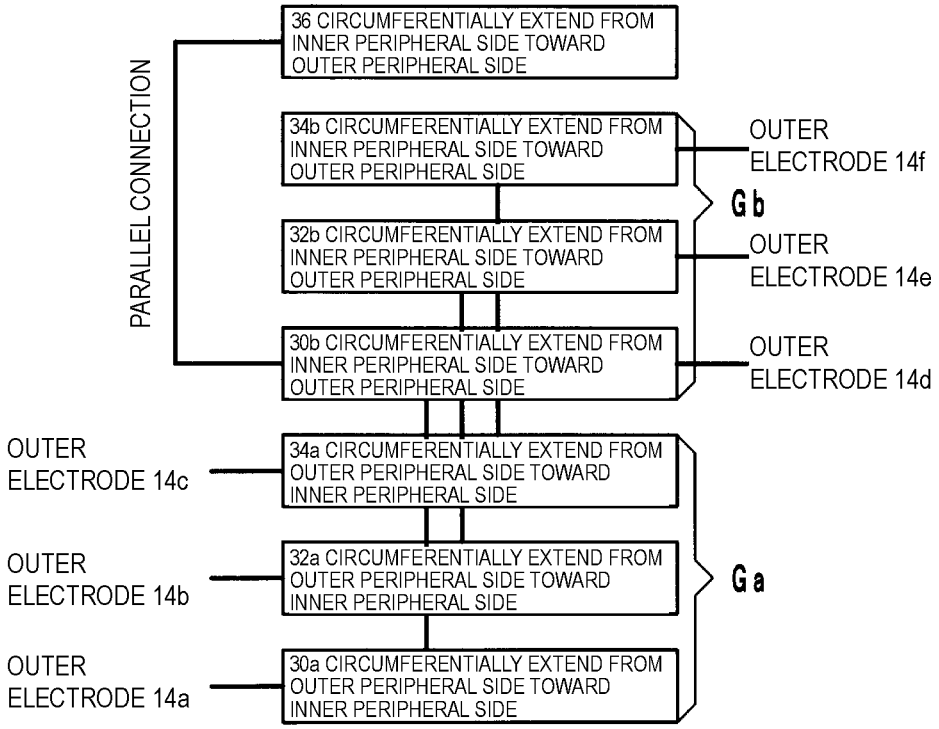
FIG. 6B is a schematic view illustrating a positional relation among coil conductor layers and a parallel coil conductor layer of the electronic component according to the first modification.

A configuration of an electronic component 10*a* according to a first modification will be described below with reference to the drawings. FIG. 6A is a schematic view illustrating a positional relation among the coil conductor layers 30*a*, 32*a* and 34*a* and the parallel coil conductor layer 36 of the electronic component 10. FIG. 6B is a schematic view illustrating a positional relation among coil conductor layers 30*a*, 32*a*, 34*a*, 30*b*, 32*b* and 34*b* and a parallel coil conductor layer 36 of the electronic component 10*a*.

In the electronic component 10, the primary coil L1 includes one coil conductor layer 30*a* and one parallel coil conductor layer 36, the secondary coil L2 includes one coil conductor layer 32*a*, and the tertiary coil L3 includes one coil conductor layer 34*a*. On the other hand, in the electronic component 10*a*, the primary coil L1 includes two coil conductor layers 30*a* and 30*b* and one parallel coil conductor layer 36, the secondary coil L2 includes two coil conductor layers 32*a* and 32*b*, and the tertiary coil L3 includes two coil conductor layers 34*a* and 34*b*. Thus, the electronic component 10 and the electronic component 10*a* are different from each other in arrangement of the coil conductor layers 30*a*, 32*a*, 34*a*, 30*b*, 32*b* and 34*b* and the parallel coil conductor layer 36, as described below.

In the electronic component 10, as illustrated in FIG. 6A, one coil conductor layer 30*a*, one coil conductor layer 32*a*, and one coil conductor layer 34*a* are arrayed in the mentioned order from the lower side toward the upper side and constitute a coil conductor layer group Ga. The parallel coil conductor layer 36 has the same shape as the coil conductor layer 30*a*. The parallel coil conductor layer 36 is electrically connected to the coil conductor layer 30*a* in parallel and is disposed on the upper side of the coil conductor layer 34*a* that is disposed at the uppermost position.

On the other hand, in the electronic component 10*a*, as illustrated in FIG. 6B, one coil conductor layer group Ga is constituted by one coil conductor layer 30*a*, one coil conductor layer 32*a*, and one coil conductor layer 34*a*, which are arrayed in the mentioned order from the lower side toward the upper side. One coil conductor layer 30*b*, one coil conductor layer 32*b*, and one coil conductor layer 34*b* are arrayed in the mentioned order from the lower side toward the upper side and constitute another coil conductor layer group Gb. The coil conductor layer groups Ga and Gb are arrayed in the mentioned order from the lower side toward the upper side. The parallel coil conductor layer 36 has the same shape as the coil conductor layer 30*b*. The parallel coil conductor layer 36 is electrically connected to the coil conductor layer 30*b* in parallel and is disposed on the upper side of the coil conductor layer 34*b* that is disposed at the uppermost position.

Figure 7A:
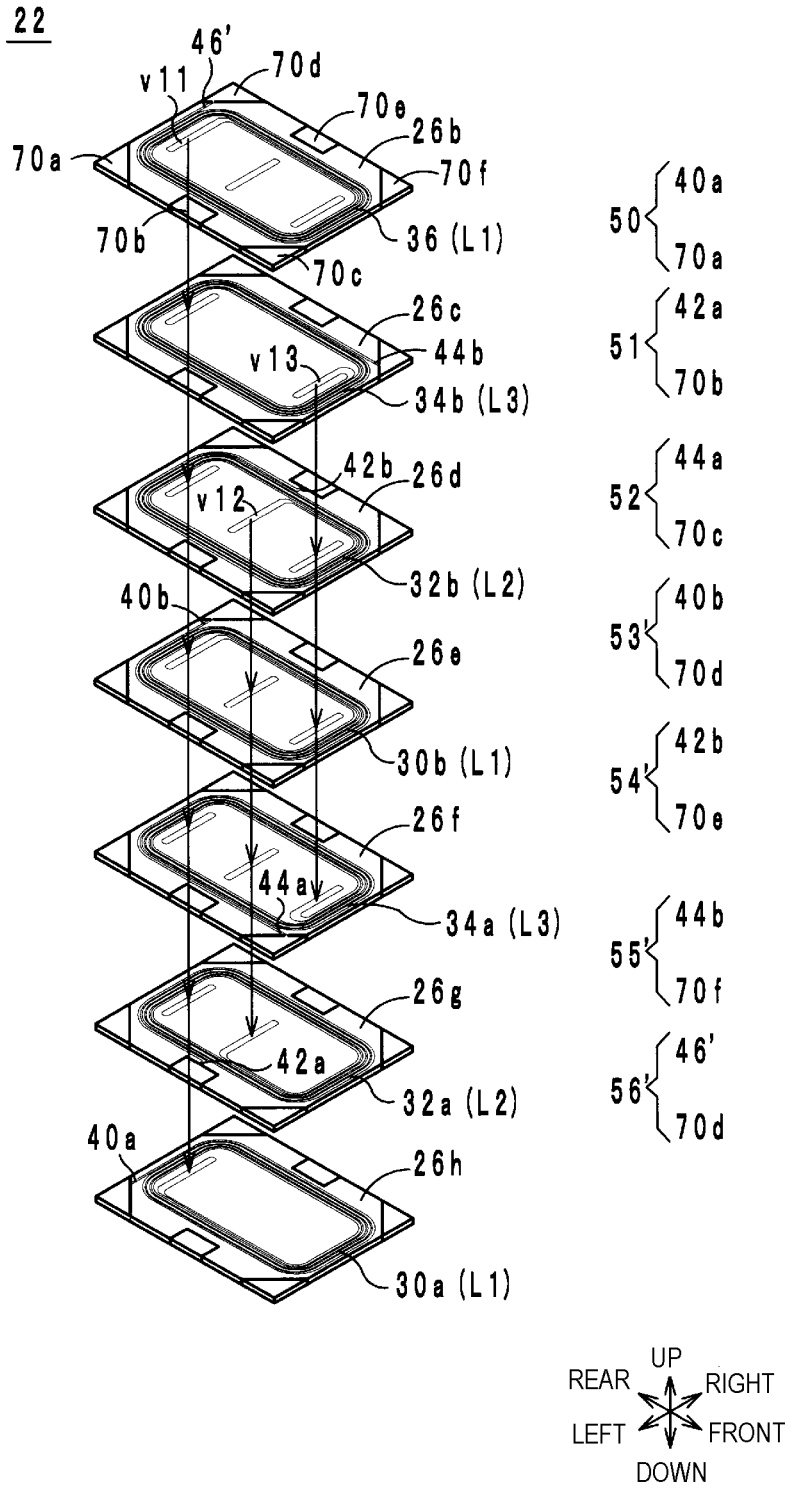
FIG. 7A is an exploded perspective view of a multilayer body of the electronic component according to the first modification.
Figure 7B:
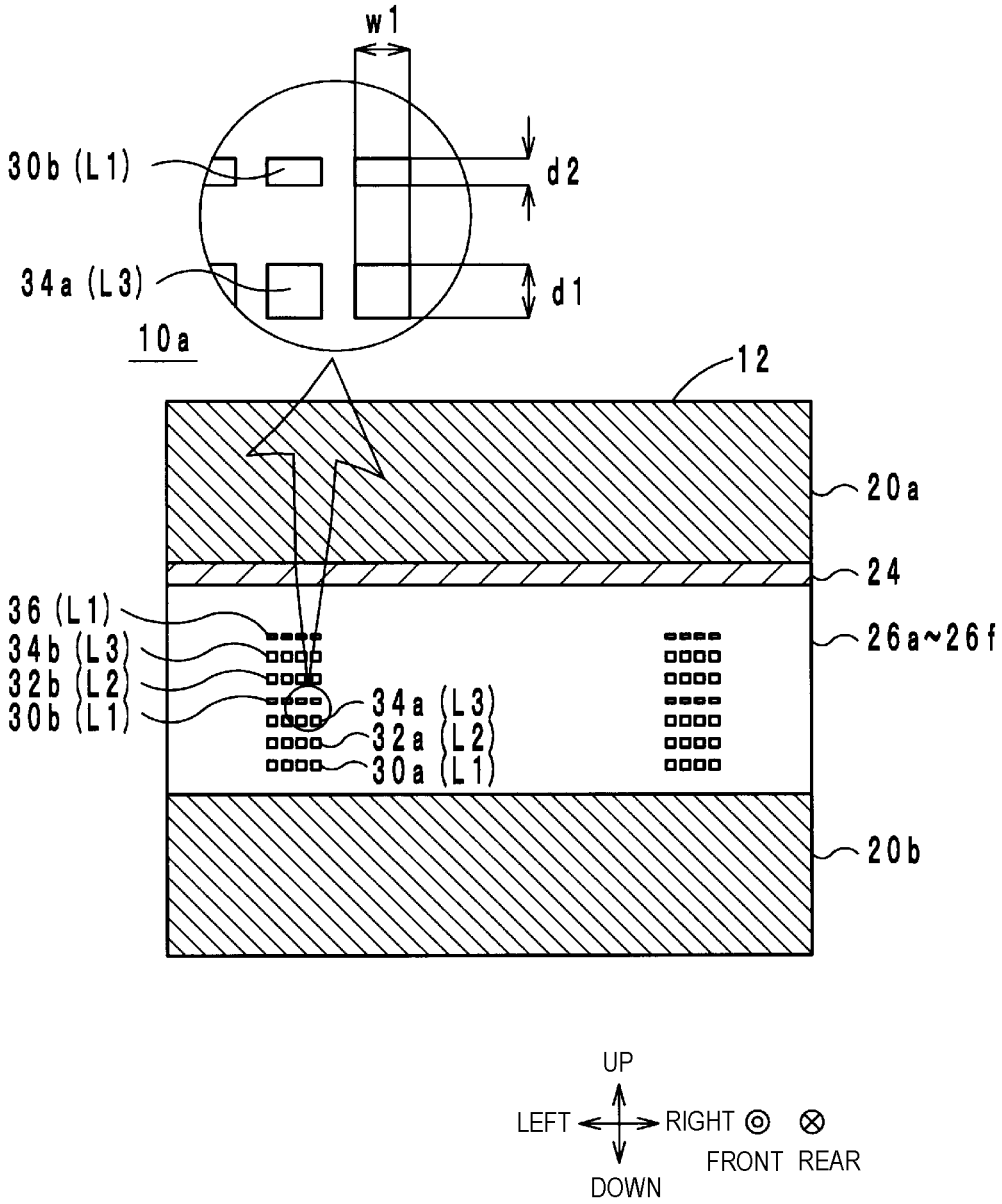
FIG. 7B is a sectional structural view, taken along 3-3, of the electronic component, illustrated in FIG. 1, according to the first modification.

A configuration of the electronic component 10*a* will be described in more detail below with reference to the drawings. FIG. 7A is an exploded perspective view of a multilayer body 22 of the electronic component 10*a*. In FIG. 7A, however, an insulator layer 26*a* is omitted. FIG. 7B is a sectional structural view, taken along 3-3, of the electronic component 10*a* illustrated in FIG. 1. FIG. 1 is further referenced to for an external perspective view of the electronic component 10*a*.

Outer electrodes 14*a* to 14*f*, connecting portions 16*a* to 16*f*, magnetic substrates 20*a* and 20*b*, and a magnetic layer 24 of the electronic component 10*a* are similar to the outer electrodes 14*a* to 14*f*, the connecting portions 16*a* to 16*f*, the magnetic substrates 20*a* and 20*b*, and the magnetic layer 24 of the electronic component 10, respectively, and hence description of those members is omitted here.

The multilayer body 22 includes insulator layers 26*a* to 26*h*, and has a substantially rectangular shape in the plan view. Shapes and materials of the insulator layers 26*a* to 26*h* in the electronic component 10*a* are similar to those of the insulator layers 26*a* to 26*f* in the electronic component 10, and hence description of the shapes and the materials thereof is omitted here.

The primary coil L1 is disposed inside the multilayer body 22 and includes the coil conductor layer 30*a*, the coil conductor layer 30*b*, and an interlayer connecting conductor v11. The coil conductor layer 30*a* in the electronic component 10*a* is similar to the coil conductor layer 30*a* in the electronic component 10 except for being disposed on the upper surface of the insulator layer 26*h*, and hence description of the coil conductor layer 30*a* is omitted here. A lead-out portion 50 in the electronic component 10*a* is similar to the lead-out portion 50 in the electronic component 10 except that a lead-out conductor layer 40*a* is disposed on the upper surface of the insulator layer 26*h*, and hence description of the lead-out portion 50 is omitted here.

The coil conductor layer 30*b* is disposed on the upper surface of the insulator layer 26*e*, and it has a substantially spiral shape extending from the inner peripheral side toward the outer peripheral side while circling clockwise in the plan view. In this embodiment, the coil conductor layer 30*b* has a length corresponding to about four times the circumference of the spiral shape. The center of the coil conductor layer 30*b* is substantially aligned with the center (crossed point of diagonal lines) of the electronic component 10*a* in the plan view.

The interlayer connecting conductor v11 is a conductor penetrating through the insulator layers 26*b* to 26*h* in the up-down direction, and has a substantially linear shape extending in the left-right direction in the plan view. The interlayer connecting conductor v11 is disposed in rear half regions of the insulator layers 26*b* to 26*h* in the plan view, and connects an end portion of the coil conductor layer 30*a* on the inner peripheral side and an end portion of the coil conductor layer 30*b* on the inner peripheral side.

A lead-out portion 53' connects the other end of the primary coil L1 (i.e., an end portion of the coil conductor layer 30*b* on the outer peripheral side) to the outer electrode 14*d*, and does not have the substantially spiral shape in the plan view, as illustrated in FIG. 7A. The lead-out portion 53' includes a lead-out conductor layer 40*b* and a connecting conductor 70*d*. The connecting conductor 70*d* is a conductor having a substantially triangular prism shape and disposed at rear right corners of the insulator layers 26*b* to 26*h*. The connecting conductor 70*d* extends in the up-down direction from the upper surface of the insulator layer 26*b* to the lower surface of the insulator layer 26*h*, and is connected at its lower end to the connecting portion 16*d*.

The lead-out conductor layer 40*b* is disposed on the upper surface of the insulator layer 26*e*, and is connected to the end portion of the coil conductor layer 30*b* on the outer peripheral side and further to the connecting conductor 70*d*. The lead-out conductor layer 40*b* does not have the substantially spiral shape in the plan view, and extends rightward from the end portion of the coil conductor layer 30*b* on the outer peripheral side. With such an arrangement, the other end of the primary coil L1 (i.e., the end portion of the coil conductor layer 30*b* on the outer peripheral side) and the outer electrode 14*d* are electrically connected to each other through the lead-out portion 53' (including the lead-out conductor layer 40*b* and the connecting conductor 70*d*) and the connecting portion 16*d*.

The secondary coil L2 is disposed inside the multilayer body 22 and includes the coil conductor layer 32*a*, the coil conductor layer 32*b*, and an interlayer connecting conductor v12. The coil conductor layer 32*a* in the electronic component 10*a* is similar to the coil conductor layer 32*a* in the electronic component 10 except for being disposed on the upper surface of the insulator layer 26*g*, and hence description of the coil conductor layer 32*a* is omitted here. A lead-out portion 51 in the electronic component 10*a* is similar to the lead-out portion 51 in the electronic component 10 except that a lead-out conductor layer 42*a* is disposed on the upper surface of the insulator layer 26*g*, and hence description of the lead-out portion 51 is omitted here.

The coil conductor layer 32*b* is disposed on the upper surface of the insulator layer 26*d*, and has a substantially spiral shape extending from the inner peripheral side toward the outer peripheral side while circling clockwise in the plan view. In this embodiment, the coil conductor layer 32*b* has a length corresponding to about four times the circumference of the spiral shape. The center of the coil conductor layer 32*b* is substantially aligned with the center (crossed point of the diagonal lines) of the electronic component 10*a* in the plan view.

As illustrated in FIG. 7A, the coil conductor layer 32*b* overlaps the coil conductor layer 30*b* substantially over the entire length in the plan view. Therefore, the coil conductor layer 30*b* (i.e., the primary coil L1) and the coil conductor layer 32*b* (i.e., the secondary coil L2) are electromagnetically coupled to each other. However, positions of both ends of the coil conductor layer 30*b* and positions of both ends of the coil conductor layer 32*b* are set to be different such that the lead-out portions 50 and 53' and later-described lead-out portions 51 and 54' do not interfere with each other. More specifically, the end portion of the coil conductor layer 32*b* on the outer peripheral side is positioned downstream of the end portion of the coil conductor layer 30*b* on the outer peripheral side in the clockwise direction. The end portion of the coil conductor layer 32*b* on the inner peripheral side is positioned downstream of the end portion of the coil conductor layer 30*b* on the inner peripheral side in the clockwise direction. With such an arrangement, the length of the coil conductor layer 30*b* and the length of the coil conductor layer 32*b* are substantially equal to each other.

The interlayer connecting conductor v12 is a conductor penetrating through the insulator layers 26*d* to 26*g* in the up-down direction, and has a substantially linear shape extending in the left-right direction in the plan view. The interlayer connecting conductor v12 is disposed in central regions of the insulator layers 26*d* to 26*g* in the plan view, and connects the end portion of the coil conductor layer 32*a* on the inner peripheral side and the end portion of the coil conductor layer 32*b* on the inner peripheral side.

A lead-out portion 54' connects the other end of the secondary coil L2 (i.e., an end portion of the coil conductor layer 32*b* on the outer peripheral side) to the outer electrode 14*e*, and does not have the substantially spiral shape in the plan view, as illustrated in FIG. 7A. The lead-out portion 54' includes a lead-out conductor layer 42*b* and a connecting conductor 70*e*. The connecting conductor 70*e* is a conductor having a substantially quadrangular prism shape and disposed at the middle of the long sides of the insulator layers 26*b* to 26*h* on the right side. The connecting conductor 70*e* extends in the up-down direction from the upper surface of the insulator layer 26*b* to the lower surface of the insulator layer 26*h*, and is connected at its lower end to the connecting portion 16*e*.

The lead-out conductor layer 42*b* is disposed on the upper surface of the insulator layer 26*d*, and is connected to the end portion of the coil conductor layer 32*b* on the outer peripheral side and further to the connecting conductor 70*e*. The lead-out conductor layer 42*b* does not have the substantially spiral shape in the plan view, and extends rightward from the end portion of the coil conductor layer 32*b* on the outer peripheral side. With such an arrangement, the other end of the secondary coil L2 (i.e., the end portion of the coil conductor layer 32*b* on the outer peripheral side) and the outer electrode 14*e* are electrically connected to each other through the lead-out portion 54' (including the lead-out conductor layer 42*b* and the connecting conductor 70*e*) and the connecting portion 16*e*.

The tertiary coil L3 is disposed inside the multilayer body 22 and includes the coil conductor layer 34*a*, the coil conductor layer 34*b*, and an interlayer connecting conductor v13. The coil conductor layer 34*a* in the electronic component 10*a* is similar to the coil conductor layer 34*a* in the electronic component 10 except for being disposed on the upper surface of the insulator layer 26*f*, and hence description of the coil conductor layer 34*a* is omitted here. A lead-out portion 52 in the electronic component 10*a* is similar to the lead-out portion 52 in the electronic component 10 except that a lead-out conductor layer 44*a* is disposed on the upper surface of the insulator layer 26*f*, and hence description of the lead-out portion 52 is omitted here.

The coil conductor layer 34*b* is disposed on the upper surface of the insulator layer 26*c*, and has a substantially spiral shape extending from the inner peripheral side toward the outer peripheral side while circling clockwise in the plan view. In this embodiment, the coil conductor layer 34*b* has a length corresponding to about four times the circumference of the spiral shape. The center of the coil conductor layer 34*b* is substantially aligned with the center (crossed point of the diagonal lines) of the electronic component 10*a* in the plan view.

As illustrated in FIG. 7A, the coil conductor layer 34*b* overlaps the coil conductor layers 30*b* and 32*b* substantially over the entire length in the plan view. Therefore, the coil conductor layer 30*b* (i.e., the primary coil L1), the coil conductor layer 32*b* (i.e., the secondary coil L2), and the coil conductor layer 34*b* (i.e., the tertiary coil L3) are electromagnetically coupled to one another. However, positions of both ends of the coil conductor layer 30*b*, positions of both ends of the coil conductor layer 32*b*, and positions of both ends of the coil conductor layer 34*b* are set to be different such that the lead-out portions 50 and 53', the lead-out portions 51 and 54', and lead-out portions 52 and 55' do not interfere with one another. More specifically, the end portion of the coil conductor layer 34*b* on the outer peripheral side is positioned downstream of the end portions of the coil conductor layers 30*b* and 32*b* on the outer peripheral side in the clockwise direction. The end portion of the coil conductor layer 34*b* on the inner peripheral side is positioned downstream of the end portions of the coil conductor layers 30*b* and 32*b* on the inner peripheral side in the clockwise direction. With such an arrangement, the length of the coil conductor layer 30*b*, the length of the coil conductor layer 32*b*, and the length of the coil conductor layer 34*b* are substantially equal to one another.

The interlayer connecting conductor v13 is a conductor penetrating through the insulator layers 26*c* to 26*f* in the up-down direction, and has a substantially linear shape extending in the left-right direction in the plan view. The interlayer connecting conductor v13 is disposed in front half regions of the insulator layers 26*c* to 26*f* in the plan view, and connects the end portion of the coil conductor layer 34*a* on the inner peripheral side and the end portion of the coil conductor layer 34*b* on the inner peripheral side.

A lead-out portion 55' connects the other end of the tertiary coil L3 (i.e., an end portion of the coil conductor layer 34*b* on the outer peripheral side) to the outer electrode 14*f*, and does not have the substantially spiral shape in the plan view, as illustrated in FIG. 7A. The lead-out portion 55' includes a lead-out conductor layer 44*b* and a connecting conductor 70*f*. The connecting conductor 70*f* is a conductor having a substantially triangular prism shape and disposed at front right corners of the insulator layers 26*b* to 26*h*. The connecting conductor 70*f* extends in the up-down direction from the upper surface of the insulator layer 26*b* to the lower surface of the insulator layer 26*h*, and is connected at its lower end to the connecting portion 16*f*.

The lead-out conductor layer 44*b* is disposed on the upper surface of the insulator layer 26*c*, and is connected to the end portion of the coil conductor layer 34*b* on the outer peripheral side and further to the connecting conductor 70*f*. The lead-out conductor layer 44*b* does not have the substantially spiral shape in the plan view, and extends forward from the end portion of the coil conductor layer 34*b* on the outer peripheral side. With such an arrangement, the other end of the tertiary coil L3 (i.e., the end portion of the coil conductor layer 34*b* on the outer peripheral side) and the outer electrode 14*f* are electrically connected to each other through the lead-out portion 55' (including the lead-out conductor layer 44*b* and the connecting conductor 70*f*) and the connecting portion 16*f*.

The primary coil L1 further includes a parallel coil conductor layer 36, one example of the parallel primary coil conductor layer. The parallel coil conductor layer 36 has the same shape as the coil conductor layer 30*b*. The parallel coil conductor layer 36 is electrically connected to the coil conductor layer 30*b* in parallel, and is disposed on the upper side of the coil conductor layer 34*b* that is disposed at an uppermost position among the coil conductor layers 30*a*, 32*a*, 34*a*, 30*b*, 32*b* and 34*b*. The parallel coil conductor layer 36 is disposed on the upper surface of the insulator layer 26*b*, and has a substantially spiral shape extending from the inner peripheral side toward the outer peripheral side while circling clockwise in the plan view. In this embodiment, the parallel coil conductor layer 36 has a length corresponding to about four times the circumference of the spiral shape. The center of the parallel coil conductor layer 36 is substantially aligned with the center (crossed point of the diagonal lines) of the electronic component 10*a* in the plan view.

An end portion of the parallel coil conductor layer 36 on the inner peripheral side is connected to the end portions of the coil conductor layers 30*a* and 30*b* on the inner peripheral side through the interlayer connecting conductor v11.

A lead-out portion 56' connects an end portion of the parallel coil conductor layer 36 on the outer peripheral side to the outer electrode 14*d*, and does not have the substantially spiral shape in the plan view, as illustrated in FIG. 7A. The lead-out portion 56' includes a lead-out conductor layer 46' and the connecting conductor 70*d*. The lead-out conductor layer 46' is disposed on the upper surface of the insulator layer 26*b*, and is connected to the end portion of the parallel coil conductor layer 36 on the outer peripheral side and further to the connecting conductor 70*d*. The lead-out conductor layer 46' does not have the substantially spiral shape in the plan view, and extends rightward from the end portion of the parallel coil conductor layer 36 on the outer peripheral side. With such an arrangement, the end portion of the parallel coil conductor layer 36 on the outer peripheral side and the outer electrode 14*d* are electrically connected to each other through the lead-out portion 56' (including the lead-out conductor layer 46' and the connecting conductor 70*d*) and the connecting portion 16*d*. Thus, the parallel coil conductor layer 36 is electrically connected to the coil conductor layer 30*b* in parallel.

As illustrated in FIG. 7B, respective line widths of the coil conductor layers 30*a*, 32*a*, 34*a*, 30*b*, 32*b* and 34*b* and a line width of the parallel coil conductor layer 36 are substantially equal to one another as denoted by a line width w1. However, each of the coil conductor layers 30*a*, 32*a*, 34*a*, 32*b* and 34*b* has a thickness d1, and each of the coil conductor layer 30*b* and the parallel coil conductor layer 36 has a thickness d2. The thickness d2 is about a half of the thickness d1. Accordingly, a total of a sectional area of the coil conductor layer 30*b*, one example of a predetermined primary coil conductor layer, and a sectional area of the parallel coil conductor layer 36 is substantially equal to a sectional area of the coil conductor layer 30*a*, one example of each of the primary coil conductor layers other than the predetermined primary coil conductor layer, a sectional area of each of the coil conductor layers 32*a* and 32*b*, and a sectional area of each of the coil conductor layers 34*a* and 34*b*.

The electronic component 10*a* having the above-described configuration can also provide similar advantageous effects to those obtained with the electronic component 10.

Furthermore, in the electronic component 10*a*, it is possible not only to obtain a higher inductance value, but also to reduce a height of the electronic component for the following reason. The reason is described by taking the primary coil L1 as an example. The primary coil L1 includes the coil conductor layers 30*a* and 30*b* and the interlayer connecting conductor v11. The coil conductor layer 30*a* has the substantially spiral shape extending from the outer peripheral side toward the inner peripheral side while circling clockwise. The coil conductor layer 30*b* has the substantially spiral shape extending from the inner peripheral side toward the outer peripheral side while circling clockwise. The interlayer connecting conductor v11 connects the end portion of the coil conductor layer 30*a* on the inner peripheral side and the end portion of the coil conductor layer 30*b* on the inner peripheral side. Thus, since the primary coil L1 of the electronic component 10*a* is constituted by the two coil conductor layers 30*a* and 30*b* connected in series, it has a higher inductance value than the primary coil L1 of the electronic component 10.

Moreover, the end portion of the coil conductor layer 30*a* on the inner peripheral side and the end portion of the coil conductor layer 30*b* on the inner peripheral side are connected by the interlayer connecting conductor v11. The end portion of the coil conductor layer 30*a* on the outer peripheral side is connected to the connecting conductor 70*a* through the lead-out conductor layer 40*a* that is disposed on the insulator layer 26*h* on which the coil conductor layer 30*a* is also disposed. The end portion of the coil conductor layer 30*b* on the outer peripheral side is connected to the connecting conductor 70*d* through the lead-out conductor layer 40*b* that is disposed on the insulator layer 26*e* on which the coil conductor layer 30*b* is also disposed. Accordingly, the lead-out conductor layer 60, which is disposed in the electronic component 10 on the insulator layer 26*b* different from the insulator layers 26*e* and 26*h*, is no longer required in the electronic component 10*a*. As a result, the height of the electronic component 10*a* can be reduced.

While the electronic component 10*a* has been described above as including the two coil conductor layer groups Ga and Gb, it may include more than two coil conductor layer groups. The following description is made in connection with the case where the electronic component 10*a* includes n coil conductor layer groups Ga, Gb, etc. n is a natural number.

When the electronic component 10*a* includes n coil conductor layer groups Ga, Gb, etc., the primary coil L1 includes n coil conductor layers 30*a*, 30*b*, etc. and the parallel coil conductor layer 36, the secondary coil L2 includes n coil conductor layers 32*a*, 32*b*, etc., and the tertiary coil L3 includes n coil conductor layers 34*a*, 34*b*, etc. The coil conductor layers 30*a*, 32*a* and 34*a* are arrayed one by one in the mentioned order from the lower side toward the upper side and constitute a coil conductor layer group Ga. The coil conductor layer 30*b*, 32*b* and 34*b* are arrayed one by one in the mentioned order from the lower side toward the upper side and constitute a coil conductor layer group Gb. The other coil conductor layer groups subsequent to the coil conductor layer group Gc are also each constituted similarly to the coil conductor layer groups Ga and Gb. The n coil conductor layer groups Ga, Gb, etc. are arrayed in the mentioned order from the lower side toward the upper side.

The parallel coil conductor layer 36 has the same shape as a predetermined coil conductor layer, one example of a predetermined primary coil conductor layer, among the n coil conductor layers 30*a*, 30*b*, etc., and is electrically connected to the predetermined coil conductor layer in parallel. In addition, the parallel coil conductor layer 36 is disposed on the upper side of the coil conductor layer that is disposed at an uppermost position among the n coil conductor layers 34*a*, 34*b*, etc.

The following description is made in connection with the case where n is an even number. In this case, the n coil conductor layers 30*a*, 30*b*, etc. in the primary coil L1 includes n/2 coil conductor layers 30*a*, 30*c*, 30*e*, etc. each of which has a substantially spiral shape extending from the outer peripheral side toward the inner peripheral side while circling clockwise in the plan view, and n/2 coil conductor layers 30*b*, 30*d*, 30*f*, etc. each of which has a substantially spiral shape extending from the inner peripheral side toward the outer peripheral side while circling clockwise in the plan view. The primary coil L1 is constituted by n/2 coil conductor layers 30*a*, 30*c*, 30*e*, etc. and n/2 coil conductor layers 30*b*, 30*d*, 30*f*, etc., which are alternately electrically connected in series. With such an arrangement, the lead-out conductor layer 60 is no longer required.

(Second Modification)

Figure 8A:
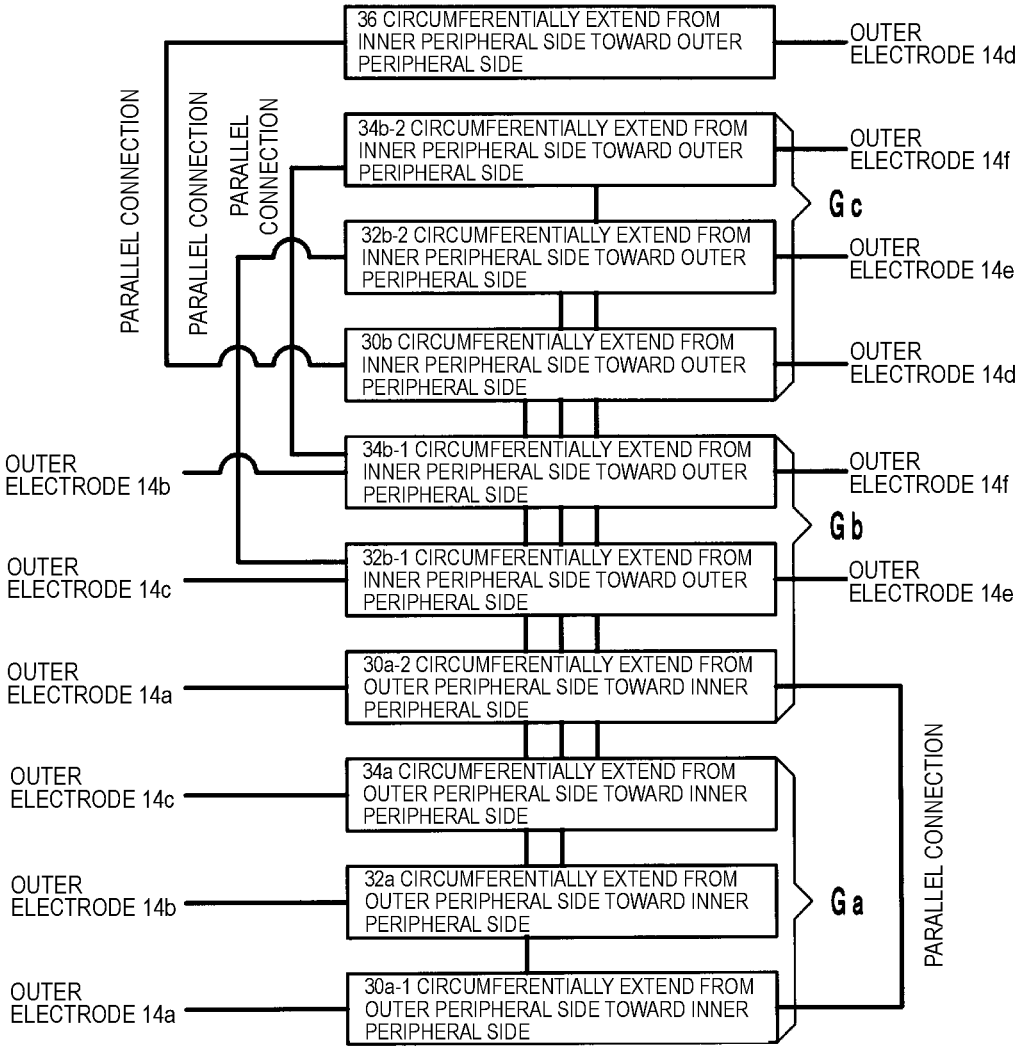
FIG. 8A is a schematic view illustrating a positional relation among coil conductor layers and a parallel coil conductor layer of the electronic component according to the second modification.

A configuration of an electronic component 10*b* according to a second modification will be described below with reference to the drawings. FIG. 8A is a schematic view illustrating a positional relation among coil conductor layers 30*a*-1, 30*a*-2, 32*a*, 34*a*, 30*b*, 32*b*-1, 32*b*-2, 34*b*-1 and 34*b*-2 and a parallel coil conductor layer 36 of the electronic component 10*b*.

In the electronic component 10*a*, as illustrated in FIG. 6B, the coil conductor layer 30*b* and the parallel coil conductor layer 36 are electrically connected in parallel. On the other hand, in the electronic component 10*b*, as illustrated in FIG. 8A, the coil conductor layer 30*a*-1 and the coil conductor layer 30*a*-2 are electrically connected in parallel, the coil conductor layer 32*b*-1 and the coil conductor layer 32*b*-2 are electrically connected in parallel, and the coil conductor layer 34*b*-1 and the coil conductor layer 34*b*-2 are electrically connected in parallel. Thus, the coil conductor layers may be connected in parallel at a plurality of locations.

Figure 8B:
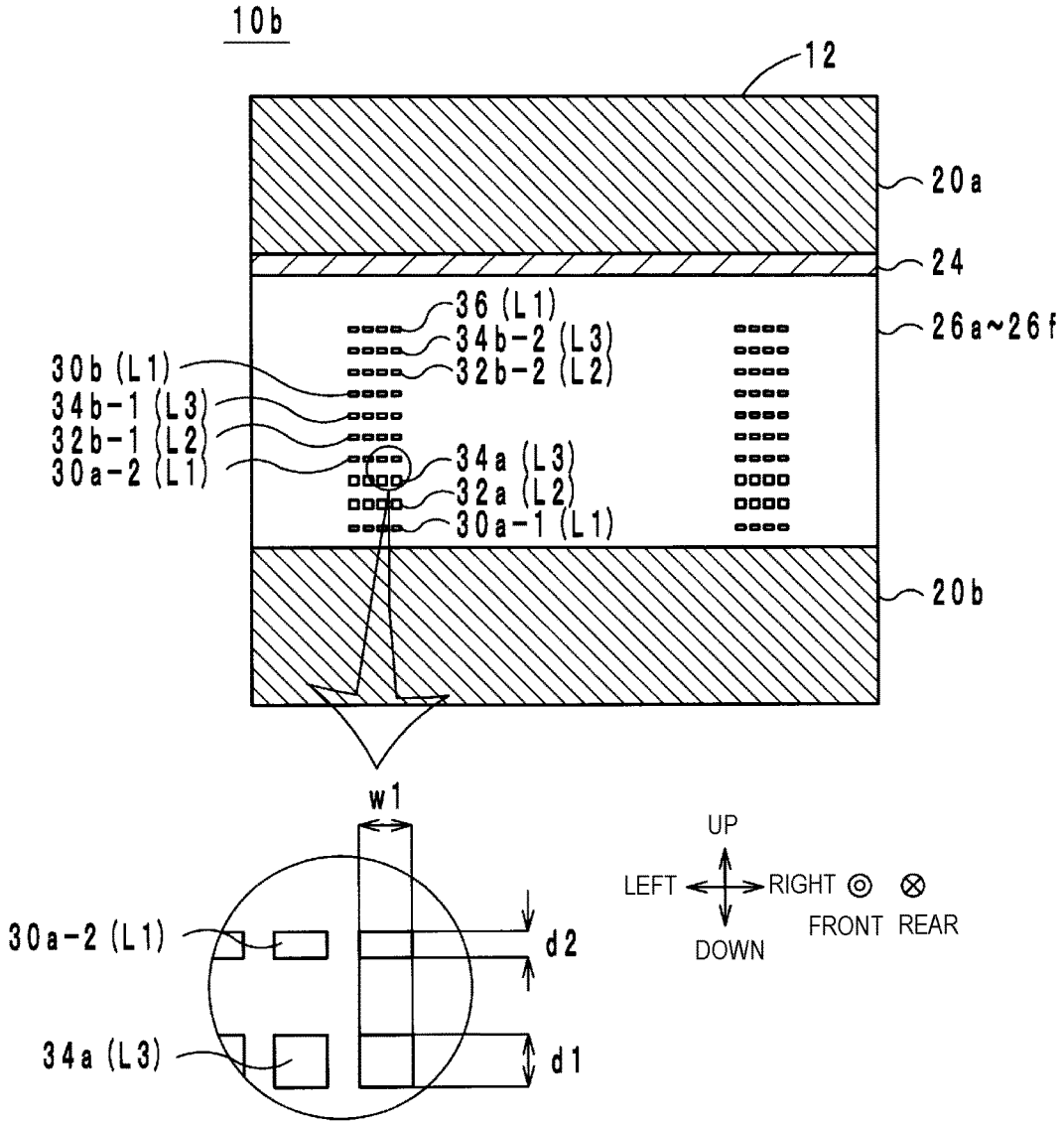
FIG. 8B is a sectional structural view, taken along 3-3, of the electronic component, illustrated in FIG. 1, according to the second modification.

A configuration of the electronic component 10*b* will be described below with reference to the drawings. FIG. 8B is a sectional structural view, taken along 3-3, of the electronic component 10*b* illustrated in FIG. 1. FIG. 1 is further referenced to for an external perspective view of the electronic component 10*b*.

The primary coil L1 includes the coil conductor layers 30*a*-1, 30*a*-2 and 30*b*, and the parallel coil conductor layer 36. The secondary coil L2 includes the coil conductor layers 32*a*, 32*b*-1, and 32*b*-2. The tertiary coil L3 includes the coil conductor layers 34*a*, 34*b*-1, and 34*b*-2. In the multilayer body 22, the coil conductor layers 30*a*-1, 32*a*, 34*a*, 30*a*-2, 32*b*-1, 34*b*-1, 30*b*, 32*b*-2 and 34*b*-2, and the parallel coil conductor layer 36 are arranged to array in the mentioned order from the lower side toward the upper side.

Each of the coil conductor layers 30*a*-1 and 30*a*-2 in the electronic component 10*b* has the same shape as the coil conductor layer 30*a* in the electronic component 10*a*. The coil conductor layer 32*a* in the electronic component 10*b* has the same shape as the coil conductor layer 32*a* in the electronic component 10*a*. The coil conductor layer 34*a* in the electronic component 10*b* has the same shape as the coil conductor layer 34*a* in the electronic component 10*a*. Each of the coil conductor layers 32*b*-1 and 32*b*-2 in the electronic component 10*b* has the same shape as the coil conductor layer 32*b* in the electronic component 10*a*. Each of the coil conductor layers 34*b*-1 and 34*b*-2 in the electronic component 10*b* has the same shape as the coil conductor layer 34*b* in the electronic component 10*a*. The parallel coil conductor layer 36 in the electronic component 10*b* has the same shape as the parallel coil conductor layer 36 in the electronic component 10*a*.

Thus, in the electronic component 10*b*, the coil conductor layer 30*a* in the electronic component 10*a* is divided into the two coil conductor layers 30*a*-1 and 30*a*-2, and the coil conductor layers 30*a*-1 and the coil conductor layer 30*a*-2 are connected in parallel. Furthermore, in the electronic component 10*b*, the coil conductor layer 32*b* in the electronic component 10*a* is divided into the two coil conductor layers 32*b*-1 and 32*b*-2, and the coil conductor layers 32*b*-1 and the coil conductor layer 32*b*-2 are connected in parallel. In the electronic component 10*b*, the coil conductor layer 34*b* in the electronic component 10*a* is divided into the two coil conductor layers 34*b*-1 and 34*b*-2, and the coil conductor layers 34*b*-1 and the coil conductor layer 34*b*-2 are connected in parallel.

Moreover, as illustrated in FIG. 8B, each of the coil conductor layers 30*a*-1, 30*a*-2, 32*a*, 34*a*, 30*b*, 32*b*-1, 32*b*-2, 34*b*-1 and 34*b*-2, and the parallel coil conductor layer 36 has a line width w1. On the other hand, each of the coil conductor layers 32*a* and 34*a* has a thickness d1, and each of the coil conductor layers 30*a*-1, 30*a*-2, 30*b*, 32*b*-1, 32*b*-2, 34*b*-1 and 34*b*-2 and the parallel coil conductor layer 36 has a thickness d2. The thickness d2 is about a half of the thickness d1. As a result, in the electronic component 10*b*, a resistance value of the primary coil L1, a resistance value of the secondary coil L2, and a resistance value of the tertiary coil L3 are substantially equal to one another.

The electronic component 10*b* having the above-described configuration can also provide similar advantageous effects to those obtained with the electronic components 10 and 10*a*.

(Third Modification)

Figure 9A:
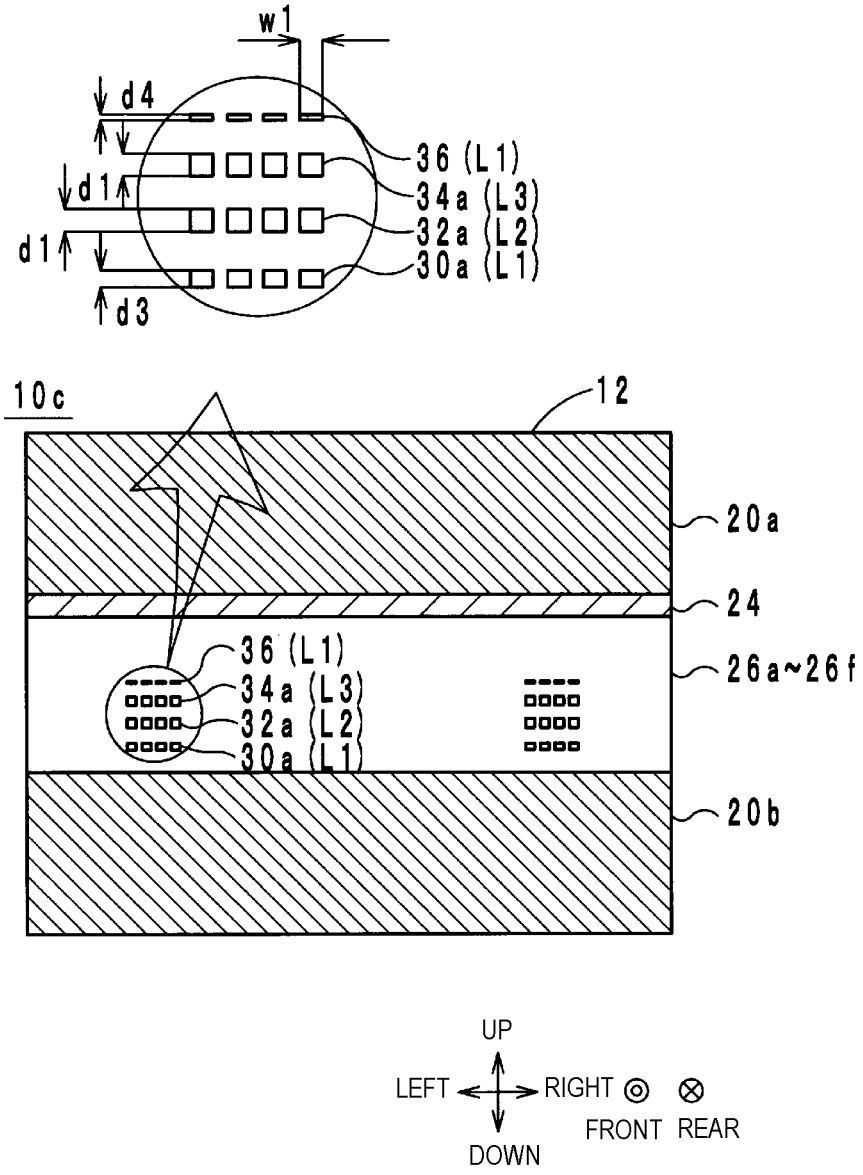
FIG. 9A is a sectional structural view, taken along 3-3, of the electronic component, illustrated in FIG. 1, according to the third modification.

A configuration of an electronic component 10*c* according to a third modification will be described below with reference to the drawings. FIG. 9A is a sectional structural view, taken along 3-3, of the electronic component 10*c* illustrated in FIG. 1. FIGS. 1 and 2 are further referenced to for an external perspective view and an exploded perspective view of the electronic component 10*c*.

The electronic component 10*c* is different from the electronic component 10 in the thicknesses of the coil conductor layers 30*a*, 32*a* and 34*a* and the parallel coil conductor layer 36. To explain in more detail, in the electronic component 10, as illustrated in FIG. 3, each of the coil conductor layer 30*a* and the parallel coil conductor layer 36 has the thickness d2, and each of the coil conductor layers 32*a* and 34*a* has the thickness d1. The thickness d2 is about a half of the thickness d1. As a result, the total of the sectional area of the coil conductor layer 30*a* and the sectional area of the parallel coil conductor layer 36 is substantially equal to the sectional area of the coil conductor layer 32*a* and the sectional area of the coil conductor layer 34*a*.

On the other hand, in the electronic component 10*c*, as illustrated in FIG. 9A, each of the coil conductor layer 32*a* and the coil conductor layer 34*a* has the thickness d1, the coil conductor layer 30*a* has a thickness d3, and the parallel coil conductor layer 36 has a thickness d4. In FIG. 9A, the thickness d3 is about ⅔ of the thickness d1, and the thickness d4 is about ⅓ of the thickness d3. Thus, the thickness of the coil conductor layer 30*a* and the thickness of the parallel coil conductor layer 36 may be different from each other. Moreover, a total of the thickness d3 and the thickness d4 is substantially equal to the thickness d1. As a result, the total of the sectional area of the coil conductor layer 30*a* and the sectional area of the parallel coil conductor layer 36 is substantially equal to the sectional area of the coil conductor layer 32*a* and the sectional area of the coil conductor layer 34*a*.

The electronic component 10*c* having the above-described configuration can also provide similar advantageous effects to those obtained with the electronic component 10.

It is to be noted that, in the electronic component 10*c*, the thickness d4 may be larger than the thickness d3.

(Fourth Modification)

Figure 9B:
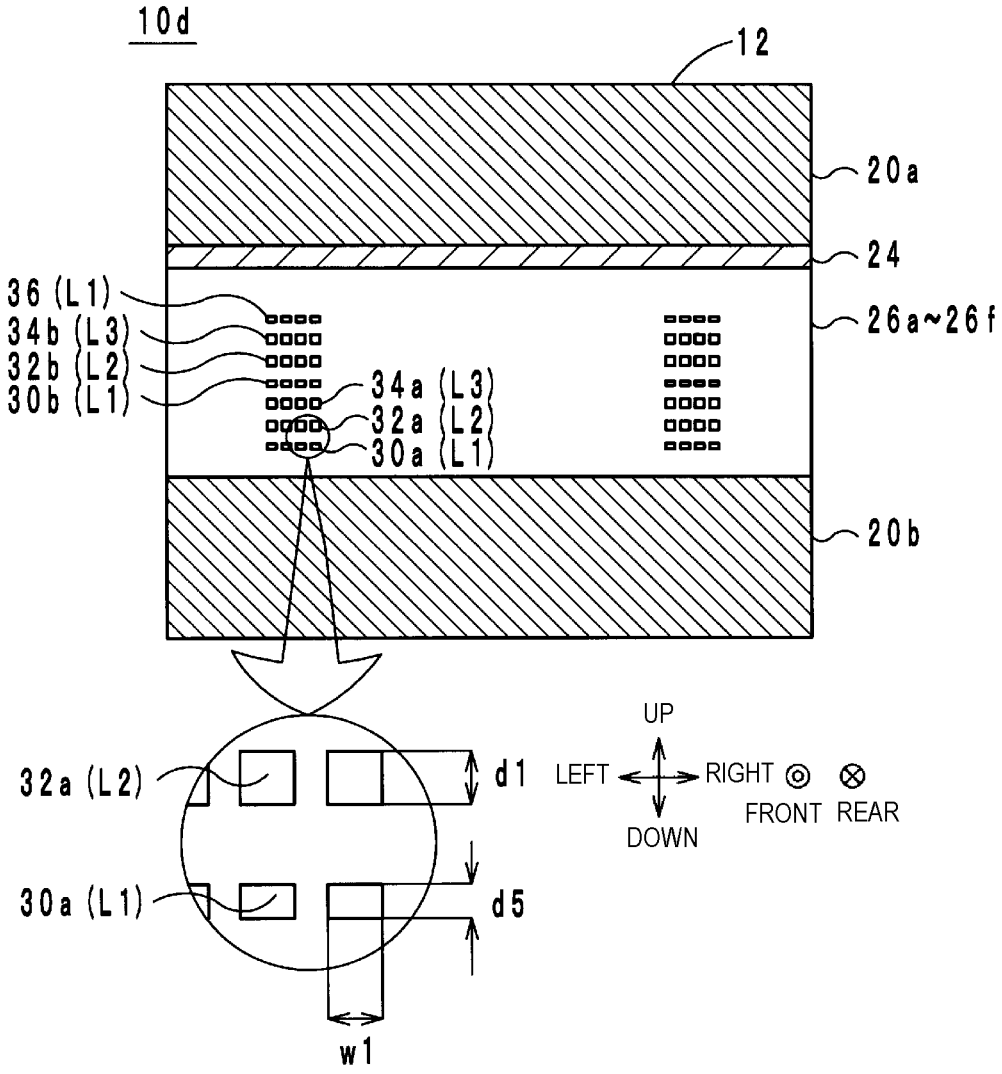
FIG. 9B is a sectional structural view, taken along 3-3, of the electronic component, illustrated in FIG. 1, according to the fourth modification.
Figure 10:
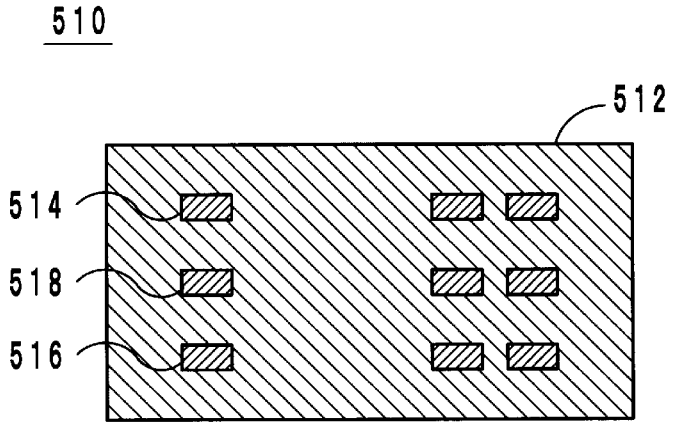
FIG. 10 is a sectional structural view of a common mode choke coil disclosed in Japanese Patent No. 4209851.

A configuration of an electronic component 10*d* according to a fourth modification will be described below with reference to the drawings. FIG. 9B is a sectional structural view, taken along 3-3, of the electronic component 10*d* illustrated in FIG. 1. FIGS. 1 and 7A are further referenced to for an external perspective view of the electronic component 10*d* and an exploded perspective view of the multilayer body 22.

The electronic component 10*d* is different from the electronic component 10*a* in that the resistance value of the primary coil L1 is different from the resistance value of the secondary coil L2 and the resistance value of the tertiary coil L3. In the electronic component 10*a*, as illustrated in FIG. 7B, the coil conductor layer 30*a* has the thickness d1, and each of the coil conductor layer 30*b* and the parallel coil conductor layer 36 has the thickness d2.

On the other hand, in the electronic component 10*d*, as illustrated in FIG. 9B, the thicknesses of the coil conductor layers 30*a* and 30*b* and the parallel coil conductor layer 36 are substantially equal to one another as denoted by a thickness d5. The thickness d5 is designed, for example, such that a conductor volume of the primary coil L1, a conductor volume of the secondary coil L2, and a conductor volume of the tertiary coil L3 are substantially equal to one another. Thus, the thickness d5 is about ⅔ of the thickness d1.

The electronic component 10*d* having the above-described configuration can also reduce the variation in differential impedances between two of the primary coil L1, the secondary coil L2, and the tertiary coil L3 as in the electronic components 10 and 10*a*.

Furthermore, in the electronic component 10*d*, the thicknesses of the coil conductor layers 30*a* and 30*b* and the parallel coil conductor layer 36 are substantially equal to one another. Accordingly, amounts of materials used to form the coil conductor layers 30*a* and 30*b* and the parallel coil conductor layer 36 can be made closer to one another, and conditions in forming the coil conductor layers 30*a* and 30*b* and the parallel coil conductor layer 36 can be set uniform. As a result, manufacturing steps for the electronic component 10*d* can be rationalized. In addition, stress concentration caused in the electronic component 10*d* due to the difference in the thicknesses of the coil conductor layer 30*a* and 30*b* and the parallel coil conductor layer 36 is reduced, and reliability of the electronic component 10*d* is improved.

Other Embodiments

Embodiments of the electronic component according to the present disclosure are not limited to the electronic components 10 and 10*a* to 10*d*, and the electronic component may be modified within the scope not departing from the gist of the present disclosure.

The configurations of the electronic components 10 and 10*a* to 10*d* may be optionally combined with one another.

In the electronic component 10, the coil conductor layer 30*a* and the parallel coil conductor layer 36 are electrically connected in parallel through the connecting conductors 70*a* and 70*d*, the lead-out conductor layer 60, and the interlayer connecting conductor v1. As an alternative, the coil conductor layer 30*a* and the parallel coil conductor layer 36 may be electrically connected in parallel through only an interlayer connecting conductor, or through a combination of the connecting conductors 70*a* and 70*d* and a connecting conductor layer without using any interlayer connecting conductor. The above point is similarly applied with respect to the electrical parallel connection of the other coil conductor layers and the parallel coil conductor layer.

While, in the electronic component 10*a*, the parallel coil conductor layer 36 is connected to the coil conductor layer 30*b* in parallel, the parallel coil conductor layer 36 may be, as another example, connected to the coil conductor layer 30*a* in parallel.

While the electronic components 10 and 10*a* to 10*d* are fabricated by photolithography in the above embodiments, they may be fabricated, for example, by a lamination technique of laminating insulator layers on which the coil conductor layers are printed.

As described above, the present disclosure is usefully applied to electronic components. In particular, the present disclosure is superior in a point that, in an electronic component including a common mode filter including three coils, difference in differential impedances between two of those three coils can be reduced.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a multilayer body constituted by insulator layers that are laminated in a laminating direction;

a primary coil including n primary coil conductor layers and a parallel primary coil conductor layer each disposed on one of the insulator layer, n being a natural number;

a secondary coil including n secondary coil conductor layers each disposed on one of the insulator layers; and a tertiary coil including n tertiary coil conductor layers each disposed on one of the insulator layers, wherein current paths of the primary coil, the secondary coil, and the tertiary coil are substantially equal to one another in length, the primary coil, the secondary coil, and the tertiary coil constitute a common mode filter, respective ones of the primary coil conductor layers, the secondary coil conductor layers, and the tertiary coil conductor layers, are arrayed in a mentioned order from one side toward other side in the laminating direction and constitute a coil conductor layer group, n coil conductor layer groups are arrayed from the one side toward the other side in the laminating direction, and the parallel primary coil conductor layer is electrically connected to a predetermined primary coil conductor layer in parallel, has a substantially same shape as the predetermined primary coil conductor layer in a plan view which is a one viewed from the laminating direction, and is disposed on the other side in the laminating direction relative to a predetermined tertiary coil conductor layer which is the tertiary coil conductor layer disposed at a farthest position on the other side in the laminating direction.

2. The electronic component according to claim 1, wherein n is a natural number of two or more, a total of a sectional area of the predetermined primary coil conductor layer and a sectional area of the parallel primary coil conductor layer is substantially equal to a sectional area of each of the primary coil conductor layers other than the predetermined primary coil conductor layer.

3. The electronic component according to claim 1, wherein the sectional area of the predetermined primary coil conductor layer and the sectional area of the parallel primary coil conductor layer are substantially equal to each other.

4. The electronic component according to claim 1, wherein the total of the sectional area of the predetermined primary coil conductor layer and the sectional area of the parallel primary coil conductor layer is substantially equal to a sectional area of each of the secondary coil conductor layers, and is substantially equal to a sectional area of each of the tertiary coil conductor layers.

5. The electronic component according to claim 1, wherein a volume of the primary coil, a volume of the secondary coil, and a volume of the tertiary coil are substantially equal to one another.

6. The electronic component according to claim 1, wherein a thickness of each of the primary coil conductor layers and a thickness of the parallel primary coil conductor layer are substantially equal to one another.

7. The electronic component according to claim 1, wherein intervals between two of the primary coil conductor layers, the secondary coil conductor layers, the tertiary coil conductor layers, and the parallel primary coil conductor layer, every two of those being adjacent to each other in the laminating direction, are substantially equal to one another.

8. The electronic component according to claim 1, wherein each of the primary coil conductor layers has a substantially spiral shape in the plan view, and the electronic component further comprises:

an outer electrode; and a lead-out conductor layer electrically connecting one end of the primary coil and the outer electrode and not having the substantially spiral shape in the plan view.

9. The electronic component according to claim 1, wherein n is an even number, each of the primary coil conductor layers has a substantially spiral shape in the plan view, and the primary coil conductor layers are electrically connected to one another in series.

* * * * *